United States Patent [19]

Gray et al.

[11] Patent Number: 4,538,719

[45] Date of Patent: Sep. 3, 1985

[54] ELECTRONIC COIN ACCEPTOR

[75] Inventors: Matthew H. Gray; Robert D. Everett, both of Monroe, Mich.

[73] Assignee: Hilgraeve, Incorporated, Monroe, Mich.

[21] Appl. No.: 510,295

[22] Filed: Jul. 1, 1983

[51] Int. Cl.[3] ..... G07F 3/02

[52] U.S. Cl. ..... 194/100 A; 324/236

[58] Field of Search ..... 340/941; 324/326, 327, 324/236; 194/100 A, 1 N, 97 R, 1 K, 1 C, 1 D, 97 A, 97 B; 133/3 C, 3 D

[56] References Cited

U.S. PATENT DOCUMENTS

| | | | |
|---|---|---|---|
| 2,230,352 | 2/1941 | Hoyt | 194/102 X |
| 2,539,855 | 1/1951 | Nelson | 194/97 |
| 3,576,525 | 4/1971 | Prucha | 340/391 |
| 3,796,295 | 3/1974 | Montolivo et al. | 194/100 A |
| 4,286,703 | 9/1981 | Schuller et al. | 194/100 A |
| 4,410,077 | 10/1983 | Okolischan | 133/3 D X |

FOREIGN PATENT DOCUMENTS

| | | | |
|---|---|---|---|
| 1527450 | 10/1978 | United Kingdom | 194/100 A |

*Primary Examiner*—Stanley H. Tollberg

*Attorney, Agent, or Firm*—Harness, Dickey & Pierce

[57] ABSTRACT

An electronic coin acceptor is described which generally comprises a synthesizer for generating a driving signal having a selectively variable characteristic, a computer for controlling the selectively variable characteristic of the driving signal such that at least one predetermined testing characteristic for each coin denomination to be tested for acceptability is selected for the driving signal in a predetermined sequence, an inductive filter for creating an electromagnetic field in response to the driving signal and for producing an alternating signal which is responsive to an electrically conductive object in the presence of the electromagnetic field, a comparator for detecting when the alternating signal crosses a predetermined threshold level and for producing a level detect signal indicative of the threshold crossing, and the computer including a counter for determining whether a conductive object in the presence of the electromagnetic field is an acceptable coin from the level detect signal. Preferably, the selectively variable characteristic of the driving signal is the frequency of the driving signal. A method of dynamically testing the acceptability of a coin is also described.

42 Claims, 21 Drawing Figures

ELECTRONIC COIN ACCEPTOR

BACKGROUND AND SUMMARY OF THE INVENTION

The present invention relates generally to coin operated devices, and particularly to electronic coin acceptors for testing the acceptability of coins.

The trend of our society toward replacement of mechanisms with solid-state devices has failed to produce a widely-used electronic coin accepting device for less complex vending and coin operated machines. While some machines in more demanding service use rather costly and elaborate electronic coin handling systems, the majority of coin operated machinery, such as video or arcade games, laundry machines and most dispensing machines, still rely on mechanical means of verifying or rejecting coins.

The standard mechanical acceptors, which typically contain delicately balanced pivoting members and magnets, are notorious for their susceptability to jamming. They are often limited to the acceptance of a single denomination of coin, and must be replaced with a different mechanism to allow acceptance of any other coin denomination. Furthermore, they are unable to distinguish between some coins of differing value, and between some coins and slugs. Attempts to supplant these mechanical units with simple, electronic acceptors have largely failed, due to reasons including the failure of the units to hold calibration, to reject slugs, or to compete with the cost of mechanical units. Additionally, more complex, but reliable electronic acceptor units have not proven cost-effective in simpler vending applications.

The method of coin discrimination employed most commonly by electronic coin acceptors is inductive coupling. The coin under test is caused to pass within the proximity of an inductive coil or element which is part of a frequency selective LC (inductor-capacitor) circuit. The characteristics of the LC circuit are affected by inductive coupling between the coil and the coin. Specifically, the coin causes a change in the loss characteristics and inductance of the coil. A certain degree of change in the these parameters is typical of a given type of coin. By suitable means of measurement of such changes, an identification of the coin can be accomplished. This method of coin discrimination is superior to other means (mechanical or electro-optical) in that it is non-contacting and is unaffected by non-metallic contamination. Another class of electromagnetic discrimination, variable reluctance, offers some of the same advantages, but due to the small size of the signal induced by coins moving at practical speeds, requires extreme amplification. This approach is vulnerable to internally and externally generated noise, both electrical and magnetic, and requires extensive shielding.

Inductive coupling of a coil with a coin as a means of discrimination of coins is the most practical method, but is not without problems. The inductive coil used for coin sensing and the LC circuit of which it is part must be extremely stable with temperature and time to allow adequate coin discrimination, as the changes induced in the circuit by a given coin may be only very slightly different from those caused by some other coin. Moreover, the auxiliary circuitry required to measure and compare the characteristics of the LC circuit to values of the characteristics typical of the given coin must also exhibit high stability (e.g., low temperature, humidity and aging coefficient). Using standard, manufacturable methods of electronic design, these demands can only marginally be met; this accounts, in part, for the failure of prior art to achieve the required coin discriminating power while giving adequate reliability freedom from loss of calibration.

The most successful solution used in prior art to this problem is to use multiple tests, each of lower accuracy. This allows more drift prior to loss of calibration, and discriminates coins by the logical ANDing of two or more tests. Further justification of this approach is the fact that a condition of the LC circuit that is characteristic of a given coin is not unique to that denomination, but may also be characteristic of some distinctly different coin subjected to the same, single test. This problem is compounded by the fact that coins, being a manufactured product, are subject to tolerances in diameter, thickness, composition, weight, and degree of stamped relief. Thus, there is not a single value of the characteristic of the LC circuit corresponding to the given coin, but a range of values of the characteristic. If a single test is used to distinguish coins, certain coins are indiscernable from other coins due to overlapping of their respective ranges of values of the LC circuit characteristic. However, if the coin under test is subjected to a variety of tests, coins indistinguishable by one test may be distinguished by another. This has been done in prior art by subjecting the coin under test to two or more complete tests, implemented in largely independent, separate and parallel circuits. This achieves the desired discrimination, but the multiplying of circuitry hardware increases the cost, complexity, and probability of electronic component failure.

Prior art inductive coin acceptors generally fall into two groups: oscillator-based units and transmitter receiver (TR)-based units. Either approach relies on the inductive coupling between coils and coins.

Oscillator-based units contain a coil which couples inductively with coins under test and which comprises a portion of an LC circuit (or tank circuit). The LC circuit is driven by an AC signal, typically a sine wave or some portion of a sine wave. The tank circuit has a characteristic loss that is a function of frequency, and this loss falls to a minimum at a certain frequency. The tank circuit is driven by an active device that, in turn, receives its input from the tank circuit. This generalized oscillator operates as a closed loop, and is self-resonant at approximately the frequency of minimum loss of the LC tank circuit. When a coin couples with the coil it changes the apparent value of the coil's inductance, which changes the frequency of minimum loss of the tank circuit, and therefore, the frequency at which the circuit oscillates. The coin also affects the amount of loss of the LC tank, which causes a change in the amplitude of oscillation.

LC oscillator-based coin acceptors use one or the other of these two effects (frequency or amplitude changes) as the basis for discrimination of coins. But there are a number of problems associated with these oscillator-based devices. Unless very well shielded, an oscillator-based acceptor's coil shows excessive sensitivity to metal objects several inches away from the coil. Re-calibration after installation in a vending machine, may be required—and may be lost if background metal should move. Also, without extensive shielding, interference between adjacent coin acceptors (or other frequency sources) can cause amplitude or frequency modulation. Environmentally induced changes in oscillator component values cause both frequency and amplitude to vary from their initial calibrated states. Oscillator-based units that use amplitude to discriminate coins are especially prone to temperature drift problems because the DC resistance of the sensing coil is strongly affected by temperature; the amplitude of oscillation is a function of coil DC resistance, and will also vary. Another problem is that frequency of oscillation may be affected by variations in delay contributed by active components in the oscillator, which may also vary with temperature or time. Additionally, since an oscillator tank circuit is necessarily a rather high impedance circuit, a variation in the load placed on the tank circuit by ancillary components may affect amplitude.

TR-based circuits can be effective, but are necessarily more complex. Generally, a transmitting coil is driven at a given frequency and is inductively coupled to a receiving coil. The coin passes between the transmitting coil and receiving coil, affecting the phase and amplitude of the received signal. Discrimination is based upon either effect. Offering a potential advantage in the fact that the transmitting coil can be low impedance, and may be driven by a high-stable externally-generated source, this circuit can eliminate some problems common to LC oscillator-based circuits (through some prior designs fail to take advantage of this potential). Also, sensitivity to nearby metal and the chances of interference from other signal sources are reduced. Adjacent acceptors can be realized more easily. However, TR circuits are generally expensive due to the need for separate transmitting and receiving circuitry.

A principal objective of the present invention is to provide a low-cost electronic coin acceptor which also eliminates the reliability problems associated with previous acceptance means. No coin acceptor can be 100% jam-proof since there must be a slot for coins; anyone intent upon jamming the slot, surely can. However, the probability of failure during normal operation is greatly reduced in accordance with the present invention by the elimination of moving parts and fingers, magnets and mechanical switches.

Additionally, in accordance with the present invention the tendancy for an electronic coin acceptor to come out of adjustment is greatly reduced by providing the electronic coin acceptor with the capability of making automatic compensations. Once the electronic coin acceptor is programmed for a given coin, it will automatically adapt itself in order to continue to accept that type of coin. Hence, potential sources of degradation to the originally-programmed criteria for acceptance of the coin (such as change in value of electronic components, wear, or accumulation of dirt) are accommodated by the device.

While greater reliability is one of the most significant advantages of the present invention, the electronic coin acceptor is relatively inexpensive and still provides several unique and advantageous features. For example, as coins are examined by passing them through an electromagnetic field, it is not necessary to physically gauge coin size or material. Hence, the electronic coil acceptor does not contain hardware specifically designed to test one particular coin or size of coin, but may be used to test a broad range of coins with equal accuracy. Coins from the size of a U.S. dime to a U.S. half dollar may be accepted without any physical alterations being required. Another feature of the present invention is the ability not only to accept a wide variety of coin denominations, but also to be able to tally the values of the coins accepted. This ability may be used either to allow graduations of cost-per-item that were not possible previously in simple vending operations, or to allow the cost-per-item to be composed of combinations of small coin denominations.

Another objective of the present invention is to provide an electronic coin acceptor whose performance is essentially immune to temperature changes in active and passive components due to temperature, humidity, aging, etc.

A further objective of the present invention is to provide an electronic coin acceptor in which interference between propinquitous sensing elements is minimized so that two adjacent coin slots may be employed in the coin operated device.

It is an additional objective of the present invention to provide an electronic coin acceptor which will permit two or more separate tests for each acceptable coin denomination with no increase in the amount of circuitry over that required to conduct one test.

It is an additional objective of the present invention to provide an electronic coin acceptor which is capable of sensing the passage of a coin or other conductive object through the slot of the coin operated apparatus with the same circuitry required to determine the acceptability of the coin.

It is still another objective of the present invention to provide an electronic coin acceptor which is capable of automatically compensating for the degree of variability of each acceptable coin denomination.

It is yet another objective of the present invention to provide an electronic coin acceptor which is capable of eliminating variations in the way the coin is entered into the coin slot from affecting the performance of the acceptor.

It is a further objective of the present invention to provide an electronic coin acceptor which is capable of eliminating "string-fraud" or "wire fraud" on the coin operated apparatus.

It is still a further objective of the present invention to provide an electronic coin acceptor which need not be disassembled in order to be inspected.

It is yet a further objective of the present invention to provide an electronic coin acceptor which may quickly and easily be programmed to accept a plurality of coin denominations by an operator in the field without requiring a knowledge of computer programming, or requiring any special tools or a need to make any mechanical or electrical fine tuning adjustments.

To achieve the foregoing objectives, the present invention provides an electronic coin acceptor which generally comprises means for generating a driving signal having a selectively variable characteristic, means for controlling the selectively variable characteristic of the driving signal such that at least one predetermined testing characteristic for each coin denomination to be tested and accepted is selected for the driving signal in a predetermined sequence, means for creating an electromagnetic field in response to the driving signal and for producing an alternating signal which is responsive to an electrically conductive object in the presence of the electromagnetic field, means for detecting when the alternating signal crosses a predetermined threshold level and for producing a level detect signal indicative of the threshold crossing, and means for determining whether a conductive object in the presence of the electromagnetic field is an acceptable coin from the level detect signal. Preferably, the selectively variable characteristic of the driving signal is the frequency of the driving signal.

The present invention also provides a method of testing the acceptability of a coin which generally comprises the steps of providing at least one testing frequency for each coin denomination to be tested, creating an electromagnetic field utilizing the testing frequencies in a predetermined sequence, and measuring the effect upon the electromagnetic field when a conductive object is in the presence of the electromagnetic field, and determining whether a conductive object in the presence of said electromagnetic field is an acceptable coin from the changes in the electromagnetic field.

The present invention further provides a coin inspecting circuit which is capable of dynamically testing the acceptability of coins. This coin inspecting circuit generally comprises means for testing a conductive object to determine whether the conductive object is an acceptable coin in accordance with a predetermined coin acceptability criteria, means for determining whether the conductive object is an acceptable coin from the result of this test, and means for selectively altering the coin acceptability criteria for subsequent determination of coin acceptability in response to the result of this test.

Additional advantages and features of the present invention will become apparent from a reading of the detailed description of the preferred embodiments which makes reference to the following set of drawings in which:

BRIEF DESCRIPTION OF THE DRAWINGS

FIG. 6 is a diagram of the frequency response of the inductive filter shown in FIGS. 1 and 3 for various coin denominations.

DESCRIPTION OF THE PREFERRED EMBODIMENT

Figure 1:
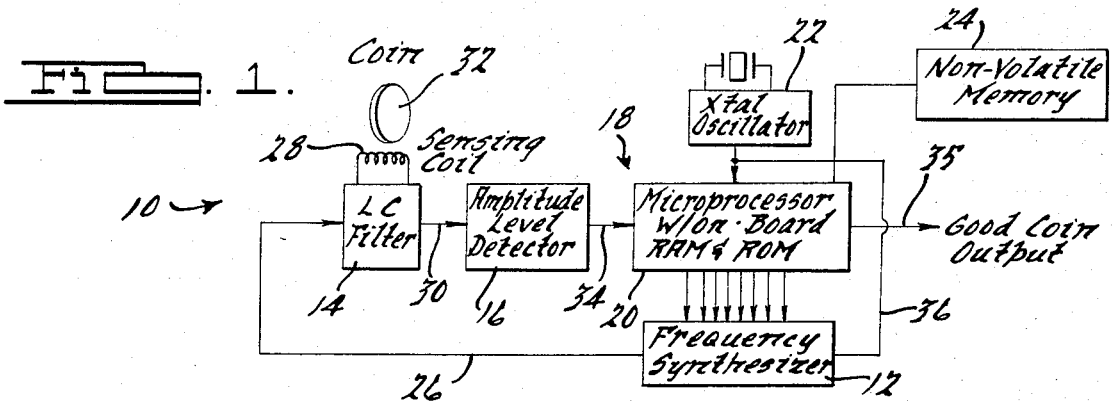
FIG. 1 is a block diagram of a coin inspecting circuit in accordance with the present invention.

Referring to FIG. 1, a block diagram of a coin inspecting circuit 10 according to the present invention is shown. The coin inspecting circuit 10 generally comprises a frequency synthesizer 12, an inductive filter 14, an amplitude level detector 16, and a microcomputer 18. The microcomputer 18 includes a single-chip microcomputer unit 20, a crystal controlled external oscillator 22 and a non-volatile memory 24. Under the control of the microcomputer 18, the frequency synthesizer generates a driving signal on conductor 26 having a selectively variable frequency. As will be more fully discussed below, the microcomputer 18 selects predetermined frequencies for the driving signal in a predetermined sequence. The inductive filter 14 uses the driving signal to create an electromagnetic field via one or more sensing coils 28. The inductive filter 14 also produces an alternating signal on conductor 30 which is responsive to a metallic or otherwise electrically conductive object in the presence of the electromagnetic field, such as coin 32.

The amplitude level detector 16 is used to detect when the alternating signal or conductor 30 crosses a predetermined threshold level, and produce a level detect signal on conductor 34 which is indicative of such a threshold crossing. The level detect signal is then used by the microcomputer 18 to sense the entrance of a conductive object into the electromagnetic field and determine whether the conductive object in the presence of the electromagnetic field is an acceptable coin. Once the microcomputer 18 determines that an acceptable coin has been received, it will produce a valid coin signal on conductor 35. The valid coin signal may then be used by a coin operated apparatus, for example, to initiate the operation of the apparatus. It may be noted at this point that the term "coin" as used herein generally means currency which is formed in whole or part by metal or is otherwise electrically conductive, including substitutes to government minted or certified money, such as tokens.

Figure 2:
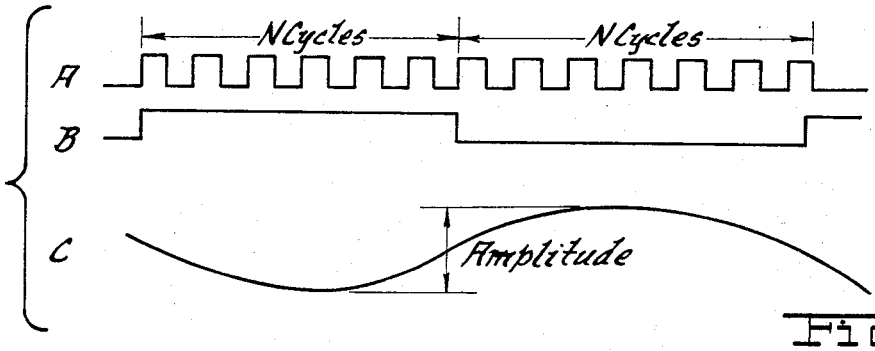
FIG. 2 is a simplified diagram of the signals at selected points in the coin inspecting circuit shown in FIG. 1.

Referring to FIG. 2, a simplified diagram of the signals at selected points in the coin inspecting circuit 10 are shown. Specifically, diagram "A" illustrates the clock signal produced by the external oscillator 22 on a conductor 36. This clock signal provides the basic timing used by the frequency synthesizer 12 to generate the driving signal. Diagram "B" illustrates one example of a driving signal on conductor 26. It should be noted that this driving signal has a generally square waveform which is related to the cycles of the clock signal from the external oscillator 22. Diagram "C" illustrates an example of an alternating signal on conductor 30, and it should be noted that this alternating signal has a generally sinusoidal waveform. Thus, it should be understood that the inductive filter 14 operates from a square wave driving signal and produces a sinusoidal alternating signal.

The inductive filter 14 provides several advantages for the coin inspecting circuit 10, one of which is the capability of the filter to operate from a square wave driving signal. This capability eliminates the need for any elaborate wave shaping circuitry which would be required if, for example, a sinusoidal driving frequency were required. Thus, the digitally-based commands from the microcomputer 18 may be readily utilized to generate a variety of square wave driving signal frequencies from the digital clock signal of the external oscillator 22.

It is also important to understand that the inductive filter 14 is an off-resonance filter, in contrast to the other forms of inductive coupling discussed above, namely oscillator-based units and TR-based units. Off-resonance filtering gives the advantage of TR circuitry while requiring only the number of passive components used in the simplest oscillator-based circuitry. Yet, the off-resonance filter 14 eliminates the problems associated with oscillator-based circuit. Since the filter 14 is driven by an externally-generated frequency and has a relatively low impedance, interference from external noise sources and sensitivity to active device loading are minimized. Adjacent coin acceptors not only do not interfere with each other's operation, they may actually be driven at the same frequency and may share a large portion of circuitry. Since the filter 14 is driven at frequencies substantially above or below the resonant frequency of the filter, the significance of the DC resistance of the coil 28 is minimized. This is due to the fact that, away from resonance, the AC resistance of the coil becomes the dominant factor in the filter performance. Whereas, at resonance, the AC resistance falls to a minimum, and the DC resistance is a strong factor in determining amplitude. The dependence of a coil's DC resistance on temperature becomes immaterial. Additionally, unlike oscillator-based units, active device propagation delays are not a concern, since the off-resonance filter 14 is operated in an open-loop configuration.

Further benefits of the off-resonance filter 14 relate to the added capabilities of the approach even though only a few passive components are used. With a single sensing element, (i.e., sensing coil 28) two or more tests may be performed on coins—tests which produce result-distributions that allow discrimination among similar but unlike coins. With the off-resonance filter 14 in accordance with the present invention, a driving signal frequency above resonance and a separate driving signal frequency below resonance will produce the same output amplitude for the alternating signal from the filter 14. Thus, it should be understood that the off-resonance filter 14 permits shared detection circuitry to be used to gauge the results of the two tests.

Figure 3:
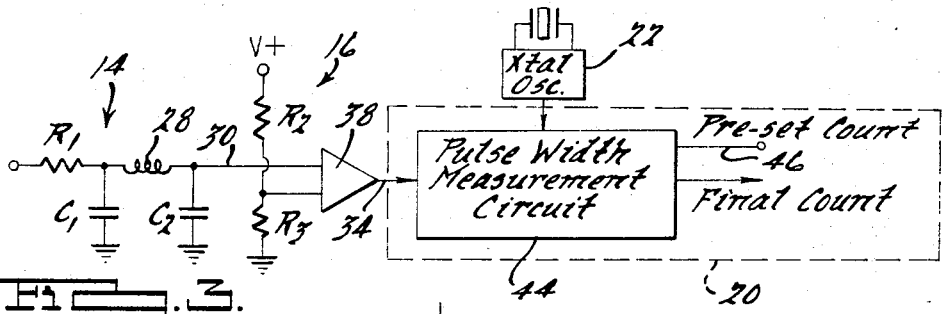
FIG. 3 is a simplified schematic diagram of a portion of the coin inspecting circuit shown in FIG. 1.

Referring to FIG. 3, a simplified schematic diagram of a portion of the coin inspecting circuit 10 is shown. In particular, FIG. 3 illustrates the off-resonance filter 14. The off-resonance filter 14 generally comprises resistor $R_1$, capacitors $C_1$ and $C_2$, and sensing coil 28. The resistor $R_1$ and the capacitor $C_1$ are connected to one end of the sensing coil 28, while the capacitor $C_2$ is connected to the other end of the sensing coil 28. As will be discussed below, the sensing coil 28 may be comprised of two inductors which are connected together in series. It should also be appreciated that other appropriate modifications may also be made to the off-resonance filter 14, and that the particular filter shown is only intended to be exemplary of a suitable off-resonance filter in accordance with the present invention.

Figure 4:
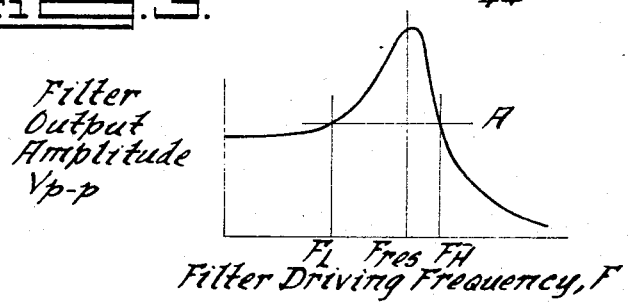
FIG. 4 is a diagram of the frequency response of the inductive filter shown in FIGS. 1 and 3.

As discussed above, the off-resonance filter 14 is driven by a square wave signal generated by the frequency synthesizer 12. This driving signal causes the sensing coil 28 to create an electromagnetic field and produce a sinusoidal waveform alternating signal of low distortion on conductor 30. This low distortion is due to the filter's high suppression of frequencies above its resonant frequency, as may best be seen with reference to FIG. 4. FIG. 4 is a diagram of the frequency response of the filter 14 shown in FIGS. 1 and 3. Since the very high frequency components of the square wave driving signal are suppressed by the filter 14, the output of the filter is largely determined by the fundamental frequency present in the driving signal, rather than any higher-order harmonic constituents which are present.

FIG. 4 also illustrates the capability of the filter 14 to produce an alternating output signal of the same amplitude from a driving signal having a frequency above the resonant frequency and a driving signal having a frequency below the resonant frequency of the filter 14. Line "A" on the diagram of FIG. 4 represents the amplitude level for the filter output produced from alternate frequencies "$F_L$" and "$F_H$" for the driving signal. Thus, even though frequency "$F_L$" is below the resonant frequency "$F_{res}$" of the filter 14 and frequency "$F_H$" is above this resonant frequency, the filter will produce alternating signals of the same amplitude. This principle permits the use of common detection and determining circuit means for interpreting the results of two distinct tests. It should also be noted that another benefit of the filter 14 is that the self-capacitance of the sensing coil 28 has little effect on the performance of the coin inspecting circuit 10, as it is small compared to, and in effect, combines with the values of capacitor $C_1$ and $C_2$.

Figure 5:
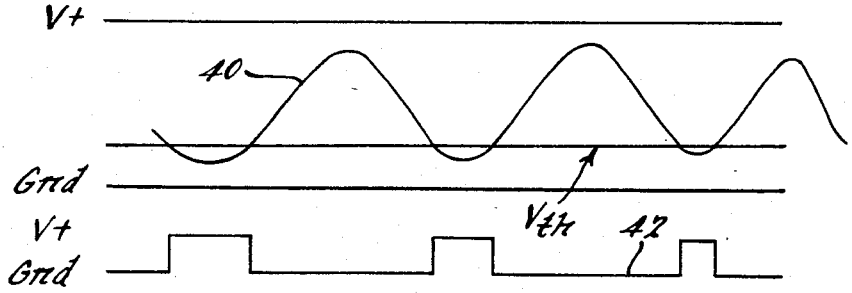
FIG. 5 is a diagram illustrating the operation of the circuitry shown in FIG. 3.

A multitude of factors, including stability, speed of detection and cost, indicate that it is preferable to limit the measurement of the filter output amplitude to a detection of how closely the amplitude achieves or maintains a single, fixed level. Accordingly, in FIG. 3 the amplitude level detector 16 is shown to comprise a single comparator 38 having a reference voltage derived from a fixed voltage "V+", and a pair of resistors $R_2$ and $R_3$. FIG. 5 provides a diagram which illustrates this amplitude detection process. The curve 40 represents the sinusoidal signal output from the filter 14 on conductor 30. The voltage dividing resistors $R_2$ and $R_3$ provide a reference voltage "$V_{th}$" for the comparator 40 which is selected to be above the lowest amplitude excursion of the sinusiodal signal output from the filter 14.

Whenever the trough of the sinusoidal signal represented by curve 40 falls below the fixed voltage threshold $V_{th}$, the output of the comparator 38 will switch to a HI logic state, as indicated by the wave form 42 in FIG. 5. Thus, the comparator 38 detects when the sinusoidal signal from the filter 14 crosses the predetermined threshold level $V_{th}$, and produces a level detect signal on conductor 34 which is indicative of this threshold crossing. Conductor 34 is connected to a pulse width measurement circuit 44 which is within or part of the integral microcomputer unit 20. The pulse width measurement circuit 44 measures the length of the HI logic state output of the comparator 38 using the crystal oscillator 22 as a time base.

The reason that a fixed threshold level, defined by a simple resistive voltage-divider, may be used is that both the driving signal for the filter and the level detection process of the comparator 38 are referenced to the supply voltage V+ and ground. As the amplitude of the filter's sinusoidal output varies, the sine wave's center will remain fixed with respect to the supply voltage V+ and ground, and therefore this center will also remain fixed with respect to the threshold level $V_{th}$.

Before discussing the pulse width measurement circuit 44 further, it should be noted that while only one fixed threshold level for the comparator 38 is utilized, additional fixed threshold levels may also be employed in the appropriate application. While the sine wave could be demodulated or conventional analog-to-digital conversion techniques could be used to process the output from the filter 14, the preferred comparison technique minimizes not only complexity and costs, but also minimizes the data conversion time and the potential for drift. Additionally, it should be noted that while the threshold level $V_{th}$ is selected to detect the lower excursion of the sinusoidal signal output from the filter 14, this voltage level could also be selected to detect the upper excursions of the sinusoidal output signal as well.

In one embodiment of the present invention, the pulse measurement circuit 44 is based upon a down counter in the microcomputer unit 20. This down counter is loaded with a predetermined count value or number via bus 46 prior to the time the driving signal is transmitted to the filter 14 or the arrival of the sinusoidal signal output from the filter. Then, in response to HI logic state output from the comparator 38, the down counter will begin counting down from the pre-loaded count value. At the completion of the down-count (i.e., when the comparator output has switched to a LO state), the remaining contents of the down counter may then be interrogated by the microcomputer unit 20. For example, software commands such as branch if minus (BMI) and branch if plus (BPL) may be employed. Thus, if the down counter contains a remaining positive value, then a certain subroutine will be jumped to, and if the down counter contains a negative value another subroutine will be jumped to by the microcomputer.

Since coins of a given denomination generally vary slightly in weight, size and the like, it is preferred that the coin inspecting circuit determine whether conductive objects are acceptable coins by providing for a coin acceptability criteria which comprises a range of values for each acceptable coin denomination. This range of values may be readily provided for by the pulse width measurement circuit 44 of FIG. 3 by conducting two successive counting measurements. Thus, the down counter will first be loaded with a count value which corresponds to the lower limit or threshold of this range and the length of the first HI logic state measured. Then, the down counter will be loaded with a count value which corresponds to the upper limit or threshold of the range and the length of the next or subsequent HI logic state measured. The use of these two successive pulse width measurements is possible due to the speed at which they can be conducted by the coin inspecting circuit 10 in comparison to the speed at which a conductive object, such as an acceptable coin, will be passing by the sensing coil 28. Accordingly, a steady stream of HI and LO logic states will be available to the pulse width measuring circuit 44 from which to make several measurements. As discussed above, it is preferred that two alternate driving signal frequencies be employed for each acceptable coin denomination to test a conductive object which enters the presence of the electromagnetic field created by the sensing coil 28. Thus, for each acceptable coin denomination programmed into the coin inspecting circuit 10, four pulse width measurements are performed by the pulse width measurement circuit 44. Specifically, the upper and lower range limits are tested for the driving signal frequency below the resonant frequency, and the upper and lower range limits are tested for the driving signal frequency above the resonant frequency.

When there is no coin or other conductive object in proximity with the filter's sensing coil 28, the microcomputer 20 alternately finds a frequency below, and a frequency above, the filter's resonant frequency. Both of these idling frequencies cause the sine-wave output of the filter 14 to attain the certain fixed amplitude. The effects of some common coins when centered within the sensing coil 28 are shown graphically in FIG. 6. It may be seen that, compared to the no-coin curve, any coin causes a shift in the frequency of peak amplitude, and a reduction in the peak amplitude value. The frequency shift results from the reduction in the inductance of the sensing coil 28 that a coin causes. The decrease in the peak amplitude when a coin is present results from an increase in the loss characteristics of the coil, due to eddy currents within the coin. Both of these affects are a function of coin material, diameter, and thickness, as well as coil design, filter components, and the degree of coupling between coil and coin. If such a filter were connected closed-loop in an oscillator, the oscillator would tend to operate at the frequency at which the peak amplitude is observed. However, for reasons discussed previously, the filter 14 in accordance with the present invention is operated open-loop, and is forced (by selection of driving signal frequency) to operate such that the filter's output sine wave is a fixed amplitude, such as amplitude "A" in FIG. 4. The driving signal frequency at which a curve crosses the amplitude level "A" on the left is the frequency below the filter resonance that will cause the output amplitude to be "A" when a certain coin (or no coin, in the case of the no-coin curve) is present. The value of this left driving signal frequency, and the frequency where a given curve crosses amplitude level "A" above the frequency of resonance are found, constitute the respective preconditions of the first and second test to which a coin or other conductive object is subjected.

Figure 7:
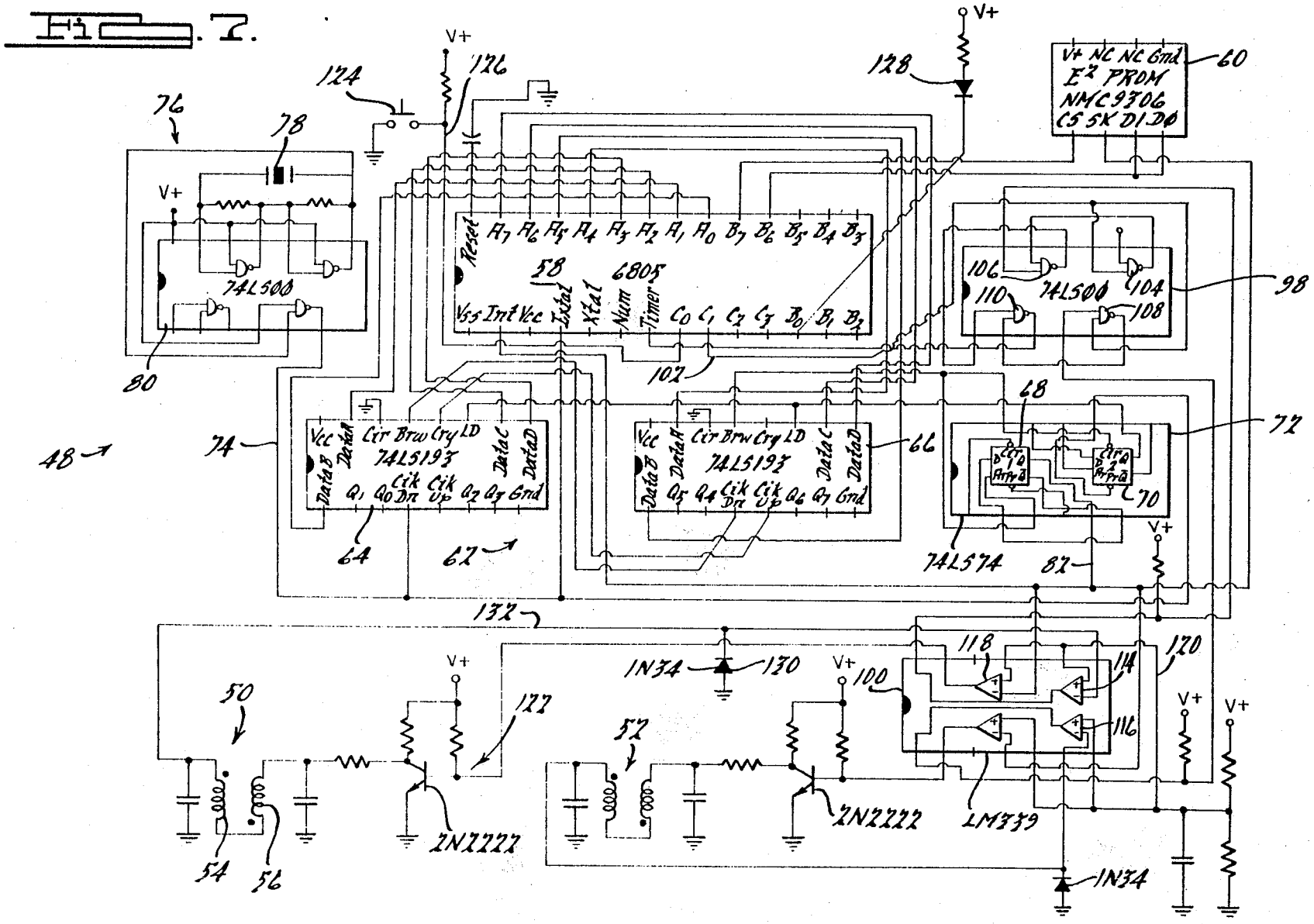
FIG. 7 is a schematic diagram of a coin acceptor circuit in accordance with the present invention.
Figure 8:
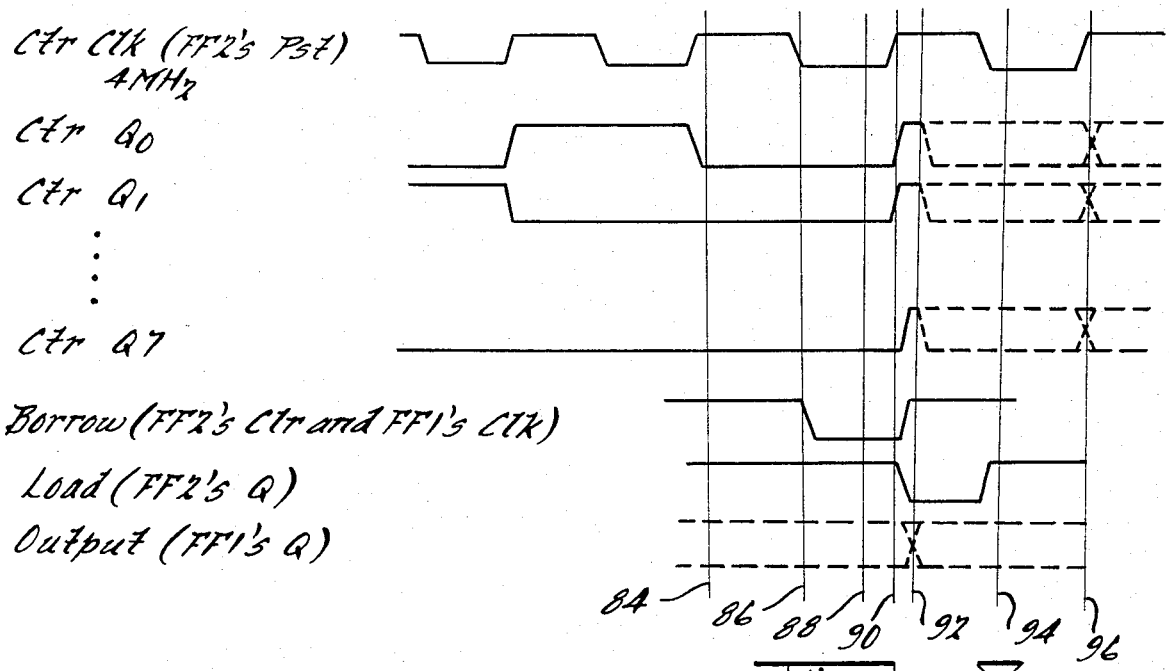

Referring to FIG. 7, a schematic diagram of a coin inspecting circuit 48 is shown. The coin inspecting circuit 48 is very similar to the coin inspecting circuit 10 of FIG. 1, except that the coin inspecting circuit 48 is adapted for an electronic coin acceptor having two coin receiving slots or chutes. Accordingly, the coin inspecting circuit 48 includes two off-resonant filters 50 and 52, one for each coin receiving slot. Each of these filters 50–52 include a pair of sensing coils connected in series, such as coils 54 and 56 in the filter 50.

The heart of the coin inspecting circuit 48 is a single-chip microcomputer unit 58, which is preferably an MC6805 series 8-bit microcomputer unit manufactured by Motorola. However, it should be understood that the specific embodiment for this circuit component, as well as the other circuit components to be described below, are intended to be exemplary only, and that suitable modifications or substitutions may also be made in the appropriate application. One of the advantages of the microcomputer unit 58 is that it contains a built-in down counter and sixty-four bytes of random access memory (RAM). Additional memory capability is provided by an electronically erasable programmable read only memory ($E^2$PROM) circuit 60, which is connected to the microcomputer unit 58. This memory circuit 60 provides 256 bits of non-volatile memory which is used to store the various count values to be loaded in the down counter of the microcomputer unit 58 and the various frequencies to be used for the driving signal.

The driving signal is generated by a frequency synthesizer 62, which is generally comprised of a pair of 4-bit synchronous up/down counter circuits 64 and 66, and a pair of flip-flops 68 and 70. For convenience the two flip-flops 68 and 70 are packaged in a single integrated circuit indicated by reference numeral 72. Additionally, the two counter circuits 64 and 66 are cascaded to form an 8-bit down counter which is decremented by a 4 MHz clock signal on conductor 74. This clock signal is generated by an external clock circuit 76, which includes a crystal 78 and three of the four NAND gates contained in IC chip 80.

The 8-bit down counter 64–66 is caused by the flip-flops 70 to repeatedly load an 8-bit value, N, and count down to negative one. Two such load/count-down cycles of the counter 64–66 comprise one cycle of the driving signal. One load/count-down cycle is the logic-low portion of the driving signal, and the other load/-count-down cycle is the logic-high portion of the driving signal. Hence, the driving signal is a true square wave (i.e., 50% duty cycle) with a period of $2(N+1)$. The driving signal output of the frequency synthesizer 62 is taken from the output of the flip-flop 68 along conductor 82. The flip-flop 68 is adapted to divide the output of the counter 65–66 by two, and is toggled once during each load/count-down cycle of the counter.

The value, N, that is loaded into the down-counter 64–66 is supplied by an 8-bit-wide data port from the microprocomputer unit 58. Since this port is dedicated to this function alone, the value, N, is constantly available to the counter 64–66 and may be loaded into the counter by the frequency synthesizer 62, asynchronously with the internal operation of the microprocomputer unit 58. Therefore, the frequency synthesizer 62 cycles by itself, independently of the sequencing of program within the microprocomputer unit 58.

Figure 8:
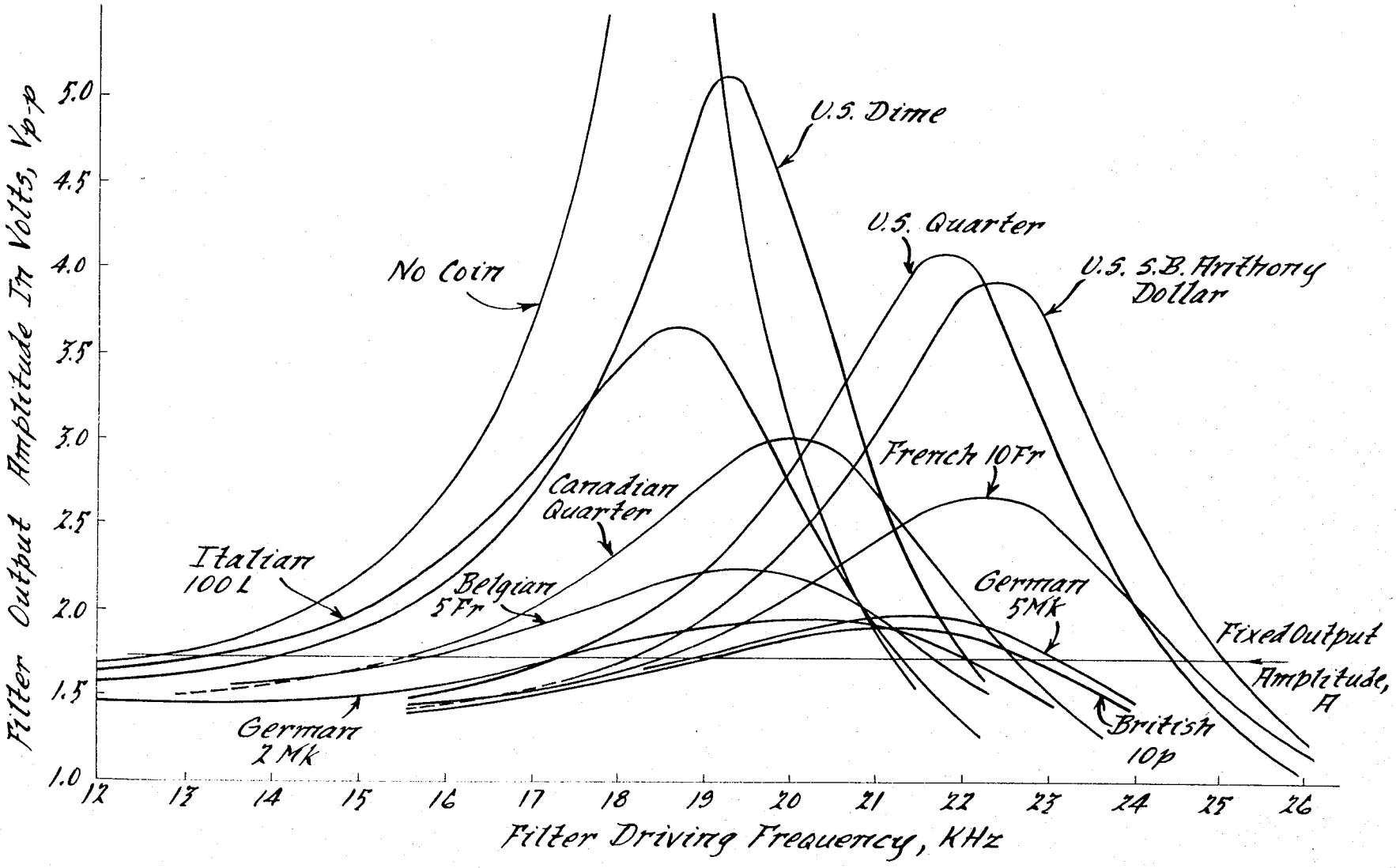
FIG. 8 is a timing diagram for the coin acceptor circuit shown in FIG. 7.

The flip-flop 70 which controls the load/down-count cycling of the counter 64–66 is used as a latch. To further understand its operation, reference may be made to the timing diagram of FIG. 8. At point 84, the counter 64–66 has been decremented until all outputs (Ctr $Q_0$–Ctr $Q_7$) are low. Then, when the next low of the counter clock signal on conductor 74 arrives, a LO Borrow (Brw) output of the counter 64–66 will be generated at point 86. This Borrow output from the counter 64–66 is applied to the clear (Clr) input of flip-flop 70. The 4 MHz counter clock signal is also applied to the pre-set Pr input of flip-flop 70. Both Clr and Pst are active-low inputs. As the 4 MHz clock signal provides a continuous stream of low pulses to Pr, the "Q" output of flip-flop 70 will normally be high (or preset). At point 88, while Clr and Pr and both low, flip-flop 70's Q output will remain high (in accordance with the truth table on the 74LS74 data sheet). At point 90, the counter clock's flip-flop 70's Pr low state has terminated. However, due to the clock-to-Borrow propagation delay of the cascaded down counter 64–66, the Borrow output (or flip-flop 70's Clr) will remain low for more than thirty nanoseconds. At point 92, the Q output of flip-flop 70 will reliably be driven low by the Borrow output (flip-flop 70's Clr), as long as Borrow remains low for at least fifteen nanoseconds, which in accordance with the counters' data-sheets, it will do. The Q output of the flip-flop 70 is used as the load command input to the counter 64–66. This load command will terminate at point 94 when the LO state of the counter clock signal arrives.

It should be noted that between points 90 and 92, the counter 64–66 outputs $Q_0$ through $Q_7$ may go high, since the counter is decremented once more after point 84, when the counter reached zero. But at point 92, the counter 64–66 is jammed to the value, N, and held at that value during the entire Load pulse. At point 94, the Load command is removed prior to the arrival of the next rising edge of the counter clock, allowing the down-count to commence with that edge, at point 96. The rising edge of the counter clock at point 90 is never directly counted, and the number of clock pulses per load/count-down cycle is therefore, not N, but is $N+1$.

As stated previously, the coin inspecting circuit 48 includes two separate off-resonant filters 50 and 52. It should first be observed in this regard that the only additional circuitry required above that shown for the coin inspecting circuit 10 which had only one filter, is a switching circuit for selecting one or the other filter. In the coin inspecting circuit 48, this switching circuitry is provided by the quad NAND gate IC chip 98. The coin inspecting circuit 48 also provides for a separate comparator connected to each of the filters 50 and 52, by virtue of the packaging of four comparators in the IC chip 100. However, it should be understood that suitable switching circuitry could also be provided so that only one comparator need be utilized.

Figure 9A:
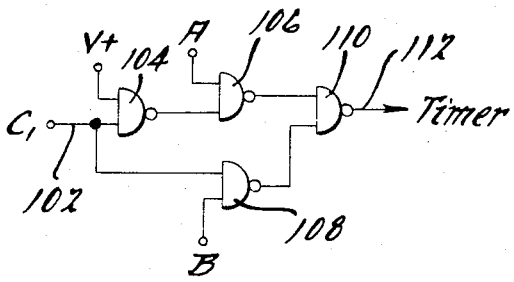
FIGS. 9*a* and 9*b* are logic diagrams for logic circuits of the coin acceptor circuit shown in FIG. 7.
Figure 9B:
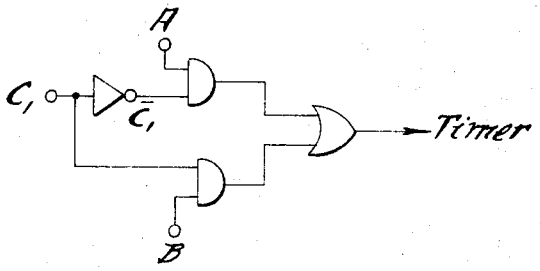

Channel selection, that is the selection between the two filters 50 and 52, is accomplished by the use of a single control line from the microcomputer unit 58, namely conductor 102 which connects the "$C_1$" port of the microcomputer unit to the switching circuit 98. The particular configuration and operation of the four NAND gates 104–110 contained in the switching circuit 98 may best be seen with reference to FIGS. 9*a* and 9*b*. FIG. 9*a* represents the actual logic diagram for the switching circuit 98, while the FIG. 9*b* represents an equivalent logic diagram of this circuit. The output from the switching circuit 98 on conductor 112 is connected to the "timer" input port of the microcomputer unit 58. In FIG. 9*a*, the input "A" to the NAND gate 106 represents the output from the comparator 114 which is connected to the filter 50, while the input "B" to the NAND gate 108 represents the output from the comparator 116 which is connected to the filter 52. Accordingly, when the microcomputer unit 58 produces a LO logic output at control port $C_1$, then channel "A" (that is, the filter 50) will be selected to transmit the digital output of its comparator 114 to the "timer" input port of the microcomputer unit. Similarly, when the microcomputer unit 58 produces an HI logic at control port $C_1$, then channel "B" (that is, the filter 52) will be selected to transmit the digital output of the comparator 116 to the "timer" input port of the microcomputer unit.

Additionally, with respect to the coin inspecting circuit 48, it should be noted that a comparator and a current driver circuit is interposed between the output of the frequency synthesizer 62 on conductor 82 and each of the filters 50 and 52. For example, in channel "A" the comparator 118 receives the output of the frequency synthesizer 62 as one input and the threshold level $V_{th}$ on conductor 120 as its other input. The output of the comparator 118 is connected to the current driver circuit 122 which together with this comparator ensures that the driving signal applied to the filter 50 has sufficient current-driving capability to achieve the appropriate amplitude excursions.

The coin inspecting circuit 48 also includes a push-button switch 124 which is used when the microcomputer unit 58 is being programmed with the coin accepting criteria of one or more coin denominations. The push-button switch 124 is connected to the connector 126 leading to the "$C_0$" control port of the microcomputer unit 58 such that the voltage applied to this control port is dependent upon the position of this switch. Additional momentary or slide action switches may also be provided for in the appropriate application. The coin inspecting circuit 48 may also include one or more indicator devices, such as the light emitting diode 128, for providing a visible and/or audio indication as to whether or not the microcomputer unit 58 determined that a conductive object was an acceptable coin. Additionally, each of the channels "A" and "B" include a diode which is interposed between the output of the filters and the comparators, such as diode 130 which is connected to the conductor 132 interconnecting the filter 50 and the comparator 114. These germanium diodes are used to protect the comparator inputs from transient voltages excursions which are more than 0.3 volts below the ground potential.

Figure 10:
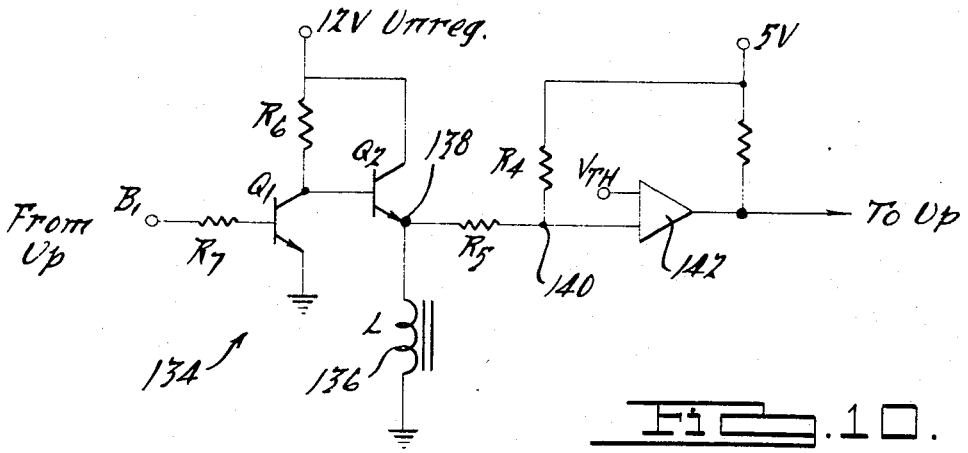
FIG. 10 is a solenoid control circuit for an electronic coin acceptor in accordance with the present invention.

Referring to FIG. 10, a schematic diagram of a solenoid control circuit 134 is shown. The solenoid control circuit 134 is used to control the energization of a solenoid in an electronic coin acceptor which will direct an acceptable coin into the coin vault or direct an unacceptable coin or other object into the coin return. The solenoid control circuit 134 is connected to the "$B_1$" output port of the microcomputer 58 for the coin inspecting circuit 48. In accordance with the present invention, the solenoid control circuit includes a solenoid 136 which has two armatures, one armature for each of the two channels "A" and "B" of the coin inspecting circuit 48. Additionally, the solenoid 136 is in a normally open state which will direct any coin or other object passing through the coin receiving chute of the electronic coin acceptor into the coin return. Thus, when the electrical power is disconnected from the coin operated apparatus employing an electronic coin acceptor in accordance with the present invention, any coin inserted into the coin acceptor will fall into the coin return. However, when an acceptable coin has been detected, the solenoid 136 will be energized to close, and thereby direct the accepted coin into the coin vault.

One of the principal advantages of the solenoid control circuit 134 is to prevent a common type of fraud associated with the coin return opening.

It is possible to defraud many coin accepting mechanisms by tampering with the mechanisms through the coin return opening. In units with microswitch-actuated credit outputs, this is commonly achieved by flipping a low-denomination coin up into the mechanism so that it falls down through the acceptable coin path, tripping the microswitch. This is called penny flipping. Another method of defrauding a coin acceptor is referred to as wire-fraud. Wire fraud is the tripping of the microswitch in the coin acceptor mechanism by means of an appropriately bent wire inserted through the coin return. Since an electronic coin acceptor according to the present invention does not have a microswitch, the electronic coin acceptor is not susceptible to these precise forms of fraud. Nevetheless, it may still be possible for a wire or a slender object to be inserted through the coin return slot and up into the coin passage in such a way that the solenoid armature could be prevented from closing and permitting the accepted coin to exit at the coin return.

This fraud could be prevented by several methods. For example, the configuration of the electronic coin acceptor could be made such that the solenoid could not be tampered with from the coin return. But this requires complicating and lengthening the coin's path through the electronic coin acceptor, and thereby increasing cost and susceptibility to jamming. Another possible solution is to issue a credit only if the coin to be accepted is detected to have been successfully deflected into the path leading to the coin vault. This requires the addition of a sensing element (mechanical, optical or inductive) along the coin's path after deflection at the solenoid and before it reaches the coin vault. This also adds to the cost and complexity of the acceptor.

Importantly, the means of preventing the above described type of fraud in accordance with the present invention requires no additional mechanical complexity. It relies on the operation of the solenoid 136 itself. When the solenoid's coil is energized, the magnetic field it generates pulls hinged ferromagnetic armatures from an open, rest position to a closed position. In the closed position the armatures block the path of coins so that coins are deflected from entering the coin return, causing them to fall instead into the coin vault. Closure of the armature also causes the value of the coil's inductance to rise significantly. This results from the fact that, when the armatures are in the closed position they very nearly contact the ferromagnetic core of the solenoid coil, increasing the inductance-amplifying properties of the coil's core. With armatures closed, the core combines with the armatures to create a nearly-closed magnetic flux path, substantially increasing the effective inductance of the coil. Therefore, by measurement of inductance, it may be determined whether the solenoid is fully closed, or is being blocked from achieving the fully-closed state. The solenoid 136 is energized upon detection of an acceptable coin for a period of about one hundred msec. After twenty msec of this period, the solenoid 136 achieves full closure. By the end of one hundred msec, an acceptable coin will have been deflected into the coin vault. Immediately following this period, a test to find the inductance of the solenoid 136 is performed. If the test indicates that the solenoid 136 was fully closed, a credit output is issued to the coin operated machine. If the test shows that the solenoid 136 was blocked, no credit is issued. This test and the operation of the solenoid control circuit 134 are set forth below.

When a coin has been determined to be acceptable by the microcomputer unit 58, it will provide a LO logic signal at output port "$B_1$" for a period of one hundred milliseconds. This LO logic signal is inverted by the transistor Q1, whose output is connected to the transistor Q2. When transistor Q2 is biased on by the HI output from the transistor Q1, the solenoid 136 will be energized. At the end of the one hundred millisecond when the solenoid is de-energized, the energy stored in the solenoid's coil would cause the voltage at the node 138 to swing significantly below ground, if it were not for the clamping effect of the transistor $Q_2$, which commences when the node 138 swings more than 1 $V_{BE}$ below ground. In effect, the transistor $Q_2$ is biased back on again by the solenoid 136, which allows the solenoid to discharge rapidly through transistor $Q_2$. The length of time required for discharge of the solenoid coil into transistor $Q_2$ is dependent on factors which include the inductance of the solenoid coil. The delay between termination of the one hundred millisecond pulse issued by the microprocomputer unit 58 and the point at which the voltage at node 138 rises back above $-1\ V_{BE}$ is used as an indication of whether the solenoid 136 actually became fully closed. At node 140, the voltage from node 138 is raised by means of resistor divider $R_4$–$R_5$ to a level slightly above $V_{th}$. With $V_{th}=0.9$ V, for example, and with the voltage at node 138 being at ground, the voltage at node 140 is 1.1 V. Therefore, during the interim period following the termination of the one hundred microsecond signal, the voltage at node 140 will be below $V_{th}$, and the output of voltage comparator 142 will be in a LO logic state.

When both armatures of the solenoid 136 are allowed to fully close, then by virtue of the solenoid's discharge delay the LO output from the comparator 142 will last for approximately fifteen milliseconds. If either armature is blocked from closing, a length of thirteen milliseconds results. The microcomputer unit 58 counts the length of the discharge delay and issues a credit only if its length indicates full closure was achieved.

The length of the LO output from the comparator 42 is actually dependent also on characteristics of transistor $Q_2$. Furthermore, the value of inductance of one solenoid may vary somewhat from that of another due to manufacturing tolerances. To account for these sources of variation, the microcomputer unit 58 in each electronic coin acceptor compares the observed discharge delay not to a fixed, standard length, but to a length the microcomputer unit 58 has observed to be typical for that particular coin acceptor. This standard for comparison may be gathered and stored by the microcomputer unit 58 during initial programming of the unit, or at intervals during operation of the unit. Accordingly, wire fraud is eliminated in an electronic coin acceptor in accordance with the present invention with the use of only a few simple and reliable circuit components.

Turning now to the operation and capabilities of an electronic coin acceptor which includes a coin inspecting circuit in accordance with the present invention, one of the principal features of the present invention is the ability to modify the initial coin accepting criteria automatically during the use of the electronic coin acceptor. Thus, for example, once the high and low driving signal frequencies and the count values for the internal down counter of the microcomputer unit 58 are programmed and stored in the E²PROM memory 60 for a U.S. quarter at the factory or in the field, any of these frequencies and/or count values may be subsequently altered by the coin inspecting circuit. This altering process is based upon an anaylsis of prior coin acceptability determinations, which may be referred to as statistical tracking.

Statistical tracking has many benefits. While coin acceptors that rely on static coin criteria require extreme accuracy in initially programmed coin criteria, the dynamic criteria provided by statistical tracking may be approximate. Prior units must be calibrated taking great care that coin criteria reflect the mean of the entire population of the particular coin denomination, not just a small random sample which may not be typical. A statistical tracking process allows a coin acceptor to be programmed quickly and simply by passing a single coin through the device. Subsequent self-refinement of the criteria ensures that coin criteria becomes representative of the entire population of the coin denomination, without regard to whether the sample was typical.

Statistical tracking is used to compensate for the degree of variability which is present for each acceptable coin denomination. Some coins show a wider manufacturing tolerance than others, and require looser test or acceptability criteria. Other coins are not round, but may have flat sides (such as the septagonal British 50P) and show greater variability in testing. While the electronic coin acceptor may be provided with an operator-selectable sensitivity adjustment, statistical tracking will permit the acceptor to automatically set the required tolerances for the tests it performs. A large "window" of coin acceptability or loose test may be used in initial programming with the electronic coin acceptor subsequently narrowing its test criteria to the extent found to be suitable from examination of coins that are accepted in operation. Thus, with this method of statistical tracking, the electronic coin acceptor will learn or teach itself more about the tolerances of acceptable coins with each coin accepted.

Statistical tracking also allows the electronic coin acceptor to compensate for long term drift in circuitry component values or wear of coin handling hardware, providing that coins of the acceptable type pass through the acceptor during the period during which such drift occurs. Another aspect of this statistical tracking allows shorter-term variations in component values to be taken into account as well.

Every time a coin passes through the electronic coin acceptor, the coin is subjected to a test wherein preconditions are applied to the LC filter (i.e., a predetermined driving signal frequency in the preferred embodiment) that will produce a fixed known outcome (i.e., a fixed output-amplitude from the LC filter) that is characteristic of one or more acceptable coins. The amount of error observed between the actual outcome (LC filter output amplitude), and the expected, fixed outcome is an indication of how closely the coin under test resembled the norm for the coin for which the electronic coin acceptor was programmed. If the amount of error falls within certain bounds, it is assumed that the coin under test was of the acceptable type. If a series of coins tested and accepted shows a sufficient trend in their direction of error, it is inferred that drift in LC filter components or some other circuit element has occurred. To compensate for the drift, the device modifies its programmed value, shifting it slightly in the direction that will, in subsequent coin tests, eliminate the trend in coin test errors. Hence, any drift that transpires over a long enough period that a statistical data base on acceptable coins may be gathered, can be compensated for. This permits the device to perform tightly selective tests of coins without requiring rigorous and expensive means of controlling component and overall circuitry drift.

This method of statistical tracking is particularly facilitated by the use of a non-volatile memory, such as E²PROM memory 60 in the coin inspecting circuit 48. Use of non-volatile storage permits the coin acceptability programming to be accomplished by simply pressing the programming push-button switch 124 to initiate a programming routine and dropping coins of the acceptable type into the coin receiving slot of the electronic coin acceptor. The appropriate, initial coin acceptability criteria for each acceptable coin denomination will then be automatically programmed into the E²PROM memory 60 by software commands from the microcomputer unit 58. Similarly, when the coin inspecting circuit 48 determines that the coin acceptability or testing criteria should be altered for a particular coin, this change may also be effected by suitable software commands from the microcomputer unit 58. Additionally, it should be noted that the electronic coin acceptor according to the present invention also permits in-field programming by users without requiring any special tools or an understanding of the acceptor's circuitry. Furthermore, if power is removed from the coin operated apparatus after the electronic coin acceptor has been programmed, the coin acceptability criteria stored therein will nevertheless be retained, such as over night.

To facilitate a further understanding of an electronic coin acceptor employing a coin inspecting circuit in accordance with the present invention, an example of a coin-test sequence will now be described. To simplify this example, the single channel coin inspecting circuit 10 will be utilized. It will be assumed that the coin inspecting circuit 10 has been programmed to accept U.S. nickels and U.S. quarters, and that the resonant frequency of the filter 14 is 12 kHz.

First, it should be noted that the test employing a driving signal frequency to the left of the resonant frequency is generally higher in resolution than the test to the right of resonance. One reason for this is that the resolution of frequency steps is better when N is larger. N is the number from the microcomputer unit 20 which determines the driving signal frequency generated by the frequency synthesizer 12. N is about 220 on the left and about 140 on the right when no coin is present. The other reason is that coin curves have a shallower slope where they intersect the amplitude level "A" shown in FIG. 4 on the left than on the right. Accordingly, the left test is better at detecting the approach of a coin and is somewhat better at coin discrimination. Therefore, the left test is used as the coin approach detector, and is the first test to be applied during a coin testing sequence. The pulse produced by threshold-comparison of the filter output by the comparator 38 will be referred to as "C". Measurement of C is accomplished with the down-counter internal to the microcomputer unit 20. This counter is clocked by the microcomputer's internal clock (a 1 MHz square wave internally derived from a 4 MHz crystal oscillator), which is gated internally with the C pulse applied to the microcomputer's Timer input. Measurement of C consists of preloading a count value into this counter, clocking the counter down during a C pulse, and evaluating the resulting counter contents. Ensuring that the counter is clocked down during only one, full C pulse is done by synchronizing the loading and subsequent content-evaluation with the filter's driving signal, which is tied to the microcomputer's external interrupt input.

Whenever the value of N is changed, there is a brief delay before the output of the filter 14 stabilizes to a constant amplitude, and may be evaluated accurately. The length of the delay varies with the value of N and with the size of change in N. It is on the order of 0.6 to 1.6 ms., while the time required for a coin to pass completely through the sensing coil 28 is about 80.0 ms. There is, therefore, a practical limitation to the number of different values of N that may be tried on a coin at the instant when that coin is substantially centered between the coils.

Proper configuration of a coin-test scheme allows certain discrimination processes to be completed prior to a coin reaching a centered position. This reduces the number of N values that need to be applied during the short period when the coin is centered. A coin causes an effect on the filter 14 that rises to a maximum as the coin rolls to the center, then decreases as it leaves the center. If it is known that an acceptable coin causes a certain maximum value of the effect when it is centered, it may be determined that a coin is not of this acceptable type if it exceeds that value at any time. Such a coin might be rejected well before it beomes centered. Taking advantage of the above technique, it is possible to single out which of several acceptable coins a coin under test might be before the coin reaches center. This is done by having the coin inspecting circuit 10 assign hierarchy to coins on the basis of the values of the above effect, after the programming of the coins, and prior to a coin-test. The coin inspecting circuit 10 then tests for the coins in order of ascending value of this effect. The coin causing the least effect is tested for first, and if that coin's effect is exceeded prior to centering, the coin under test is not that first coin, but may be any of the other acceptable coins. The test for the coin causing the next larger value of the effect is then applied, and so on. If a coin under test does not exceed the maximum effect for the acceptable coin whose test is being applied, the coin will become centered, and will then be tested in additional ways for full verification. Table 1 illustrates a sample coin testing sequence in accordance with this technique.

TABLE 1

| | SAMPLE COIN TEST SEQUENCE | | | |
|---|---|---|---|---|
| Condition | Left N | Left C Range | Right N | Right C Range |
| No Coin Scanning | 221 | 1 to 7 | 143 | 1 to 12 |
| U.S. nickel | 209 | 2 to 6 | 143 | 5 to 9 |
| U.S. dime | 209 | 4 to 7 | 140 | 4 to 9 |
| U.S. quarter | 178 | 3 to 7 | 130 | 7 to 10 |

Figure 11:
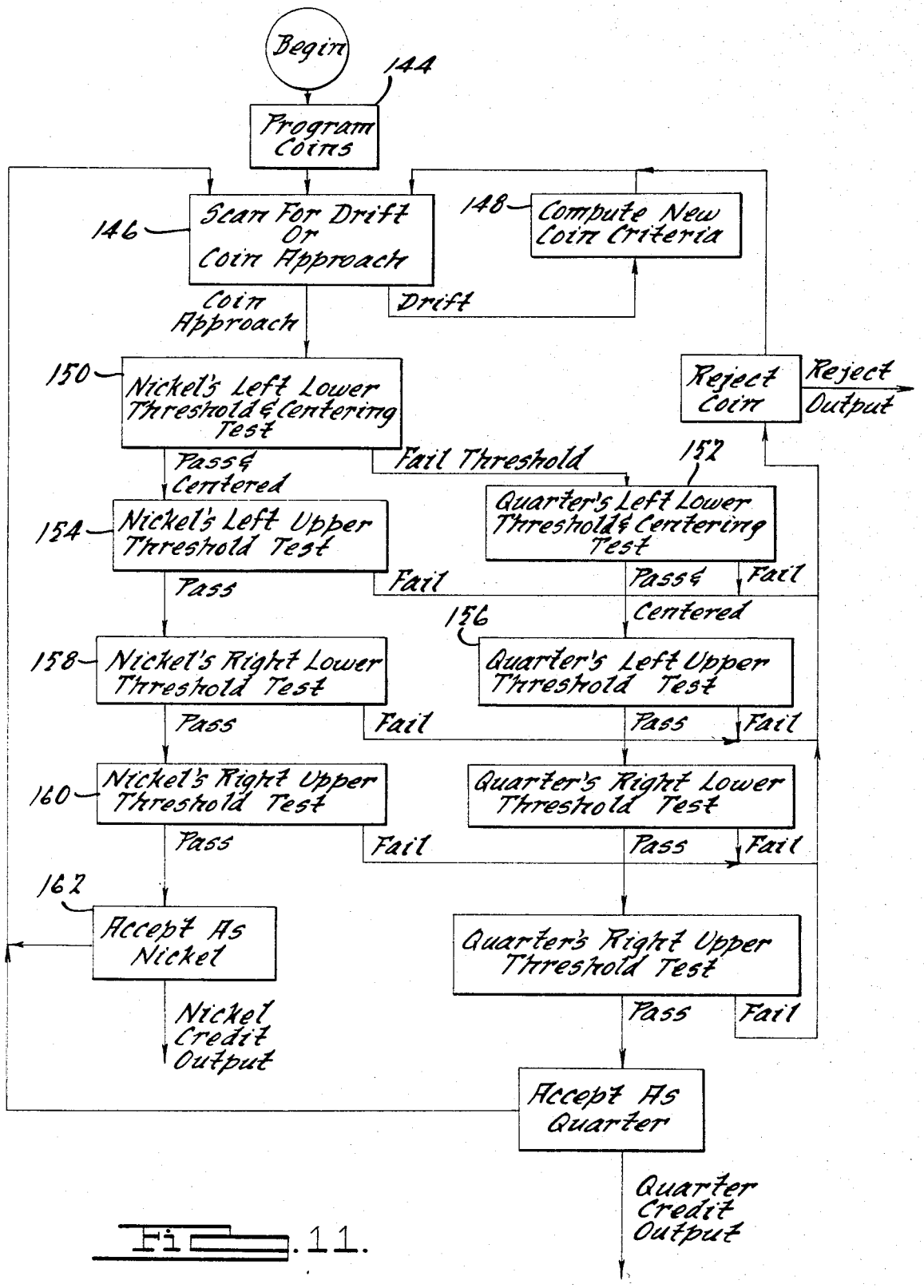
FIG. 11 is an overall flow chart for an electronic coin acceptor in accordance with the present invention.

Referring now to FIG. 11, an overall flow chart is shown of the programming for the coin inspecting circuit 10 in this example. After the coin inspecting circuit has been programmed to accept U.S. nickels and quarters (block 144), the circuit enters a mode in which it will scan for a coin approach or circuit component drift (block 146). The coin inspecting circuit 10 normally operates in this state, monitoring the filter 14 for changes in state. Assuming the circuit 10 has been powered for a few moments, results of left and right frequency tests will be constant within the repeatability of the tests. The method of scanning is to repeatedly apply the last N values known to be characteristic of this state to see thay they are still valid, as indicated by the values of C that result. In this example, these values are N=221 with C=1 to 7, on the left, and N=143 with C=1 to 12 on the right.

If on the left, a C falls out of the 1 to 7 bounds, N is incremented in the direction that should drop C back onto the center of the 1 to 7 range. If within a period of about fifteen milliseconds after such a first change in N, the net change in N is two steps in the same direction, a coin is approaching, and the unit jumps to the coin-test routine.

When the left N makes a net changes of only one step in a period of about two hundred milliseconds (following its first step in N), a drift has occurred. The circuit 10 then jumps to the routine (block 148) that computes new coin criteria that correspond to the new state of the filter 14, then returns to scanning.

If, on the right, a C falls out of the 1 to 12 range, the right N is incremented in the direction that should drop C back into the center of the 1 to 12 range. When the right N makes a net change of one step in a period of about two hundred milliseconds drift has occurred. The circuit 10 then jumps to the routine that computes new coin criteria, then returns to scanning.

When the approach of a coin or other conductive object is detected, the circuit 10 immediately applies the left test of the coin dictated by hierarchy. This will be the coin whose left N is closest to the left scanning N. In this example, the left N's are 221 for scanning (no coin), 209 for a nickel, and 178 for a quarter. The nickel's N will be applied first (block 150). Since the coin has not yet centered, the immediate effect will be that a long C will be produced. C's length will decrease as the coin approaches center.

During this first coin testing process, two monitoring functions are performed, namely the effects of the coin are observed to determine if the effects are greater than could be caused by the coin whose test is currently being used, and the effects are monitored to find if the coin has become centered.

The effects of the coin under test are too great if it causes a C pulse shorter in length then the minimum length known to be characteristic of the acceptable coin. In this example, a nickel is known to produce a C of length ranging from 2 to 6. In this testing process, if the length of C falls below 2, the coin is known not to be a nickel. This test is performed by preloading the value, 2, into the counter of the microcomputer unit 20 and counting down during a C pulse. If the result remaining in the counter is zero or less, the C pulse was at least as long as the minimum length acceptable for a nickel. To evaluate the counter contents, conditional branching commands that indicate whether the contents are positive, negative, or zero are employed. This preload/count-down/evaluate process is repeated on successive C pulses until this test is failed or until the coin becomes centered. If this test is failed, the coin could still be a quarter. Accordingly, the circuit 10 would jump to block 152 if this were to occur.

The coin is known to be centered if the sum of the contents remaining in the microcomputer down counter after the last five C pulses decreases from the sum obtained after the previous C pulse. This indicates that C has reached a minimum length (while not becoming too short be a nickel) and begun to increase in length. Typical values of counter contents before centeredness is detected are 252-253-253-253-253-252-252 (this downcounter is an 8-bit device, and rolls over if the count goes below zero). The final 252 count causes the circuit 10 to conclude that the coin has become centered. If the coin is centered while the nickel's test is being applied, the unit goes to block 154 on the flow chart.

Having found the coin under test to be centered and not to have too short a C, the circuit 10 continues to apply the nickel's left N, but preloads the upper limit value of C (C=6) into the counter (block 154). After one C, the contents of the counter are examined. If a value of less than zero is found, C was greater than the upper limit, and the coin is rejected. Again, a conditional braching command is used to evaluate the contents of the counter. If the coin does not fail this test, the circuit 10 proceed to block 158.

Having passed the full left test for a nickel, the coin is subjected to a nickel's right N (N=143) and the lower C limit (C=5). If the coin fails, it is rejected. If it passes, the test of block 160 is applied. Still applying the nickel's right N, the upper C limit (C=9) is tried (block 160). The coin is rejected if it falls. If it passes, it is accepted as a nickel (block 162).

If the coin is determined not to be a nickel at block 150, the tests for determining if the coin is a quarter will be applied, beginning at 152 (and continuing through block 156, etc.), in a procedure similar to that described for the nickel. While in this example the coin inspecting circuit 10 has been programmed to accept two coin denominations, the testing process used may easily be extended to the acceptance of a greater number of coin denominations. In such a case, additional levels of hierarchy must be assigned and tests for each additional coin denomination must be programmed into the circuit.

It should also be noted that there is a possibility that the circuit 10 may be programmed for two coins whose left tests overlap or coincide. Most often the right test will not overlap in such cases, allowing the coins to be discriminated on the basis of the results of the right test. As it happens, a U.S. nickel and dime are an example of this case. The coin testing scheme as illustrated in the previous example must be modified to handle such an eventuality. The left tests of the two coins are still performed in the same way, according to hierarchy. But in cases where left tests literally coincide, the coin that was programmed first is tested for first. In the event that the coin becomes centered and the left tests have failed to eliminate either coin as a possibility, the right tests of both coins may be applied. The circuit 10 examines coin criteria after the programming of coins and before the testing of coins, configuring itself to handle such cases when they occur.

Figure 12:
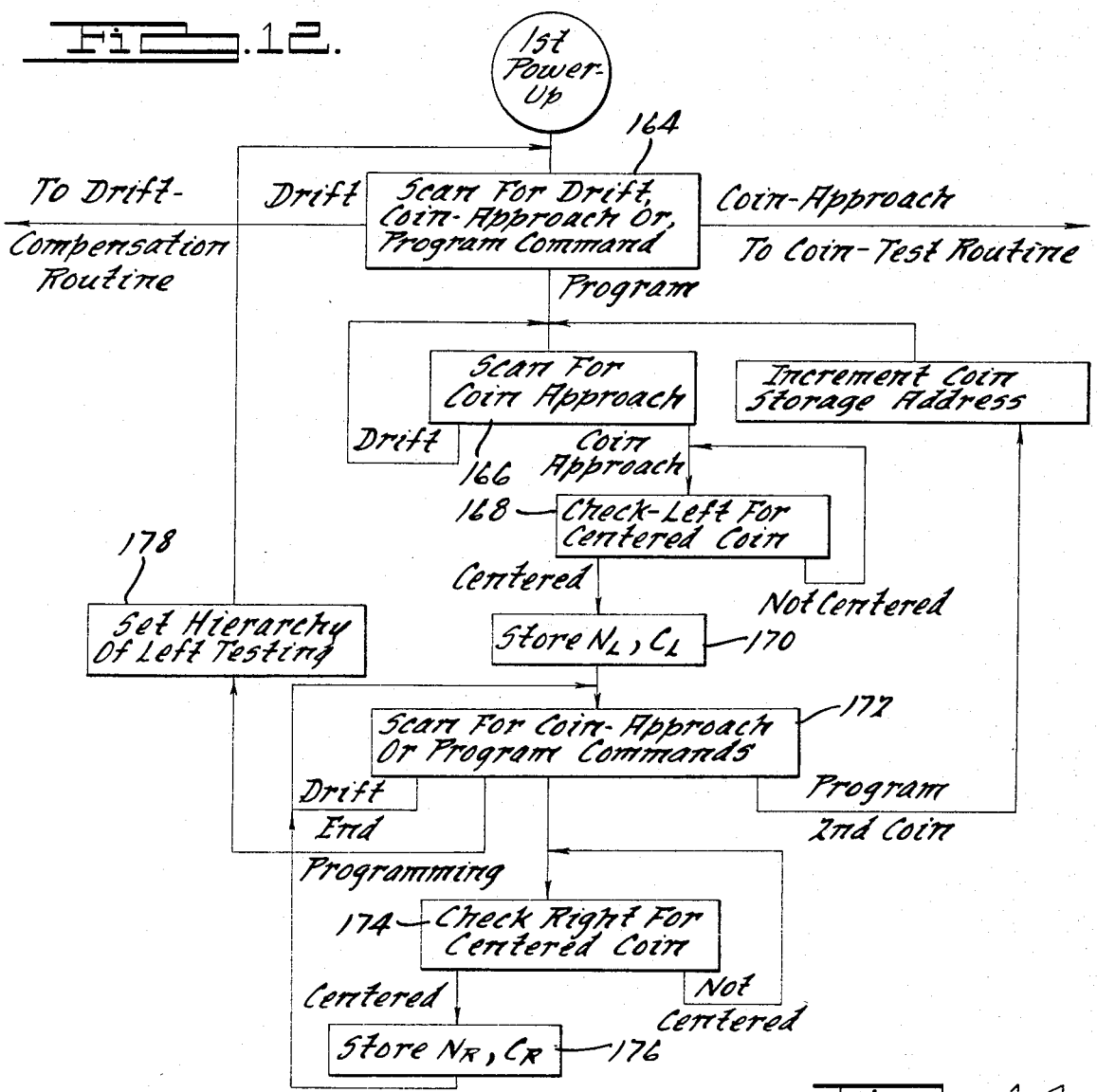
FIG. 12 is a flow chart for the program subroutine shown in FIG. 11.

Referring to FIG. 12, a flow chart of the coin programming sequence of block 144 in FIG. 11 is shown. This example of a coin programming sequence will be described in connection with the limitations and assumptions of the previous example for the coin-testing scheme. Also, the tabulating or accumulation of coin values will be kept simple. Receipt of the two coins that the circuit 10 will accept will result in issuance of a credit to the host vending machine through only two selectable combinations of the coins: (1) If one of both of the two coins is received, or (2) If one of either of the two coins is received. These combinations are the ANDing and ORing of the two coins. Both of these outputs will be available at output terminals on the electronic coin acceptor; either may be selected by the operator or manufacturer at the time of connecting the unit to the host machine. Therefore, there will be no switches required in this example for the purpose of programming relative values of coins or for programming cost per credit.

The microcomputer unit 20 jumps to the programming routine upon detection of closure and release of a momentary contact programming switch, such as switch 124 of circuit 48. An indicator light, such as LED 128 of circuit 48, begins blinking to indicate that the circuit 10 is ready to receive sample coins. The switch is tied to an input to the microcomputer unit 20 and is polled by the microcomputer periodically.

Using the same method for coin-approach detection explained in connection with block 146 of FIG. 11, the circuit 10 prepares to intercept and examine a sample coin deposited by the operator (block 164). Any randomly selected coin of the acceptable type may be used. The circuit 10 continues to scan until approach is sensed (block 166), then proceeds to a left test for the centered coin (block 168).

In a procedure similar to that used in the previous step, the circuit 10 attempts to maintain a value of C in a given range (C greater than or equal to 9). But due to the fact that a coin is approaching, the value of N required to achieve the desired C must be repeatedly decremented. Taking a quarter as an example, N must be repeatedly decremented from an original value of 221 minus 2 or 219, at the point when coin-approach is detected, down to 178 at the time when the quarter is centered.

N is decreased in steps of 2 every time C becomes less than 9 in length. The rate of decrease is changed to steps of 1 if the counts of five C pulses in a row are each 9 or longer. This indicates that a coin is drawing near the center of the sensing coil 28 (at a given value of N during a left-of-resonance test). It may be recalled that the value of C grows smaller as a coin approaches center, then it gets larger again as it departs from the center. Henceforth, every time C becomes shorter than 9, N is decremented. If C decreases in length after a change in N while not falling below 9, then increases in length, the coin is known to have become centered. As in the coin testing process, the centered point is actually determined by the point at which the sum of the counter contents after the 5 most recently measured C's decreases from the sum obtained after the previous C pulse. For a quarter, the values likely to be obtained are N=178 and C=3 to 7.

The value of C at the point of inflection is used to compute upper and lower C limit values which are stored along with the corresponding value of N in the $E^2$PROM 24 (block 170). This coin, or another of the same denomination must be passed through the unit once more to obtain the values of N and C that will be used for right-testing. N's and C's for both right and left tests cannot be obtained from a single pass of a coin during the programming process. In this embodiment, the tracking method generally lacks the speed required to obtain accurate values, characteristic of a centered coin, during a single pass of the coin. To await the second pass of a coin, the circuit 10 proceeds to block 172.

Using the same procedure as in block 166, the circuit 10 again monitors the state of the filter 14 by applying the left-of-resonance, no-coin driving signal frequency to the filter 14 and attempting to maintain a given range of values of C. Though the next coin to approach will be examined for right-test criteria, the left test is used to detect coin-approach, as it is the more sensitive to approaching coins. When the approach of a coin is detected, the circuit 10 proceeds to block 174.

Upon detection of the approaching coin, the value of N formerly found to be characteristics of the no-coin, right-of-resonance test is applied. This right tracking process is similar to the left tracking process described for block 168, with several significant differences. While in the left test any coin requires a lower value of N than that required with no coin present, in the right test, the direction of change in N may be positive or negative. Therefore, in the right tracking process, the target value for C has both lower and upper bounds (C=9 to 12), and N is altered in the direction that moves C back into the desired range. As it happens, all of the example coins (nickel, dime, and quarter) cause a decrease, or no change, in N. A given coin will cause the required N to shift only in one direction; there is never an inflection in N except for that occurring when the coin passes through the coils' center. Once the direction of N change (or in the case when no N charge occurs, the direction of C change) is known, the nature of the inflection that indicates that the coin is centered is known. The sum-of-five-C's test is used to find the point of inflection while checking for appropriate polarity in the change of the sum.

Another difference between this right test and the left test is that the net change between the no-coin right N and the coin-centered N is smaller. It is small enough that steps of two in changing N are not required; the unit just decrements or increments N during the right test.

In the case of the example coin, the approach of the quarter causes C to become larger than the upper limit of C=12, and N is decremented. This occurs repeatedly as the quarter approaches center. When sufficiently close to center, C stays within bounds without a change in N being required. Successive C's become longer, then cease to change, and then decrease. The inflection is detected, and the circuit 10 proceeds to block 176.

The values of N and C limits for the right test when the coin is centered are stored in the $E^2$PROM 24, just as for block 170. Now sufficient coin criteria for performing full left and right tests on this coin are stored. The indicator light stops blinking, showing the operator that the unit is now programmed for the coin. However, in order to avoid operator induced errors the unit returns to block 172. From this point, if the coin is passed through the unit again, it will merely re-collect the right test data, returning again to block 172. If the programming button is depressed and released once at this point, the circuit 10 increments the coin criteria storage addresses, starts blinking the indicator light again, and returns to block 166 to scan for the approach of the second coin for which the unit is to be programmed. If the button is depressed a second time, it terminates the programming sequence. The circuit 10 then goes to a routine that compares left-test coint criteria of the coins to be accepted, setting testing priority between the two coins, or hierarchy (block 178).

Figure 13:
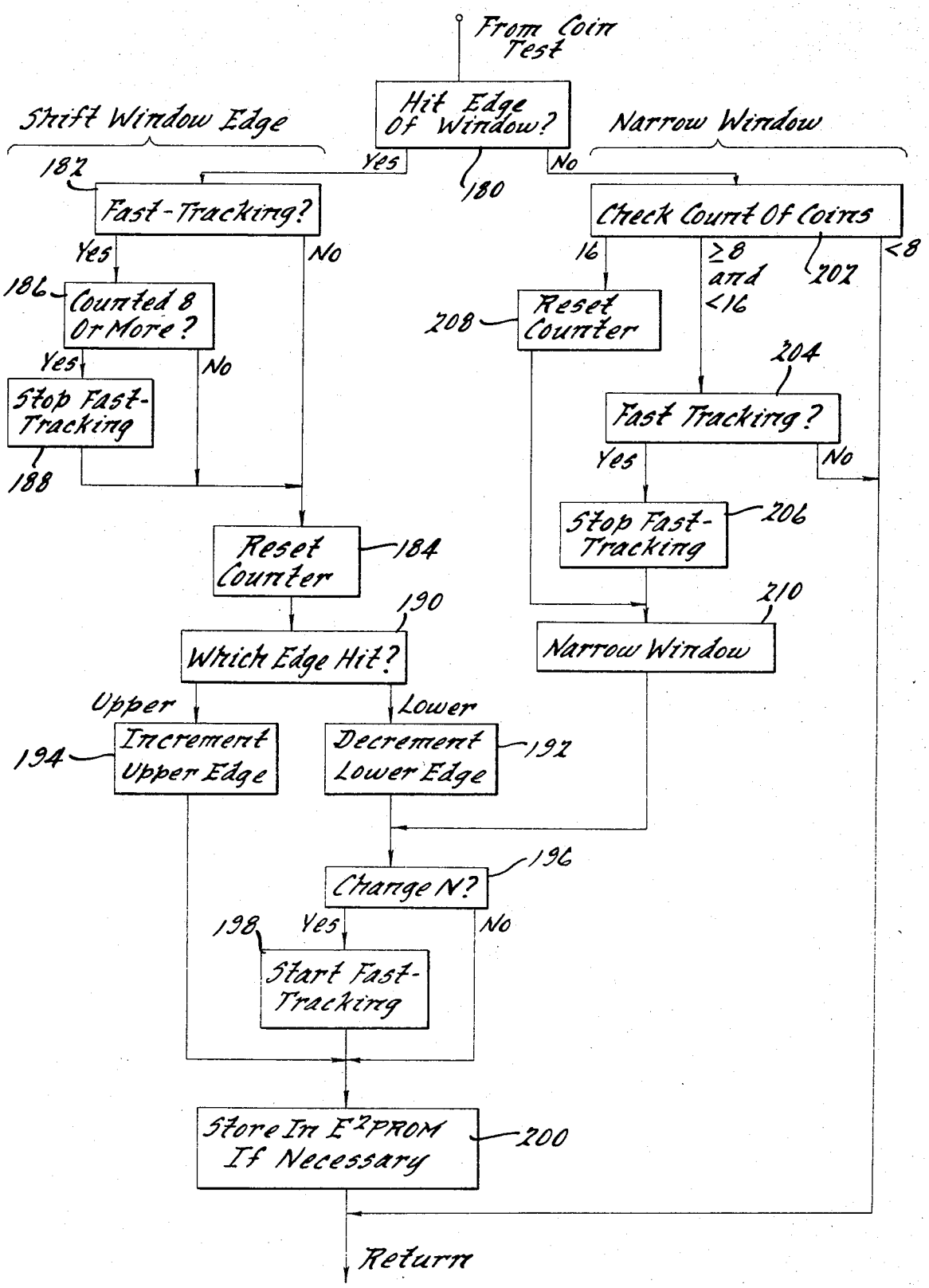
FIG. 13 is a flow chart of the coin criteria subroutine shown in FIG. 11.

Referring now to FIG. 13, a flow chart of "compute new coin criteria" block 148 in FIG. 11 is shown. This flow chart represents one example of a method of statistical tracking which is in accordance with the present invention. However, to facilitate an understanding of this method, a further discussion of the reasons why statistical tracking is particularly advantageous is presented.

A given coin, as a population, does not change significantly with the passage of time. Thus, the objective of statistical coin tracking is not to keep up-to-date on variable characteristics of coins. Rather, the primary purpose is to strip from measurement of coins the variability of measurement technique. Seeking to eliminate such variability at its source by selection of electronic components that have high stability can provide a partial solution. However, without resorting to extraordinary and expensive measures, a circuit cannot approach the degree of stability required to give adequate coin discrimination while maintaining long-term reliability. Having an electronic coin acceptor continuously refresh its knowledge as to the true characteristics of the coin it is to accept allows the coin discriminating power and long-term reliability essential to a coin acceptor, while retaining economic feasibility.

The sources of variability of electronic coin measuring devices fall into two categories: (1) continuous or slow changes, or (2) step or fast changes. Continuous or slow changes include, for example, changes in ambient conditions. Wear in mechanical elements that affect position of the coin as it is tested is a slow or continuous change. Additional examples include the accumulation of dirt on these mechanical elements. However, in terms of an electronic coin acceptor that adapts itself on the basis of acceptable coins passing through it, change that is slow with respect to the flow of good coins, is a slow change.

With regard to step or fast changes, certain changes will always be fast, without regard to the flow of good coins. A shift in relative position or spacing of the sensing coils resulting from impact or improper reassembly might result in such a change. A wire within the host vending machine falling against a sensing coils' outer surface might cause a step change. Sudden change in value of some critical electronic component might also qualify. However, beyond these changes, any substantial change that occurs during a period when the coin acceptor has low or no flow of acceptable coins is a fast change. If a coin acceptor were to experience an ambient temperature change of 50° F. during a period when few or no good coins passed through it, it could constitute a fast change.

A coin inspecting circuit in accordance with the present invention has different ways of dealing with these two types of changes. Statistical tracking on the basis of coins accepted compensates for slow changes. Fast changes are detected by observing change in the no-coin state of the filter, and compensating for them merely by making the coin inspecting circuit temporarily less selective.

Before describing the tracking scheme set forth in FIG. 13, a few limitations and considerations should be noted. Generally speaking, the $E^2$PROM, 24, may be rewritten no more than 10,000 times without risk of errors. Hence, a tracking scheme should preferably revise data stored in the $E^2$PROM only when the error between it and actual, current data exceeds a certain threshold.

When the lower edge of a left or right coin test's window bcomes too close to C=0, the value of N must be changed by one, to produce a new edge for the lower window less close to C=0. Similarly, when the lower edge gets too far away from C=0, N must be changed by one in order to bring it back toward C=0. The reason for the former change is that C cannot be measured if it becomes zero. The later change is required due to the fact the larger C becomes, the less it changes for a given change in sine wave amplitude. Therefore, sensitivity is best if the lower edge of the coin's window is kept close to C=0.

If such a change in N is made, a new location for the C window is required. The precise location and width of the window can be computed, but such calculations are generally awkward in a single-chip microcomputer. Therefore, when a change in N must be made, the window is preferably placed at an approximation of the correct location, and is widened somewhat to accommodate error in the approximation. The coin-tracking process subsequently narrows and repositions the window.

Also, when the coin inspecting circuit is first programmed, a wide window is used. The sample coin used to program the unit cannot be assumed to be truly average for its denomination. The coin may represent an extreme of the distribution of the coin's population. Therefore, the coin-tracking process, again, is relied upon to refine the programming, by relocating and narrowing the window as prescribed by the coins accepted subsequently. The method of tracking according to the present invention relies on two, independent techniques. The width of the window is reduced when a certain number of coins are accepted that do not coincide with the upper or lower edges of the window. For example, with an initial window of C=4 to 10, if 16 coins are accepted without a single coin producing an actual value of either C=4, or C=10, the window would be reduced to C=5 to 9. The assumption is that, if out of this many coins, none hits either boundary, the window is wider than necessary. But this technique cannot work alone, as it merely narrows the window.

A separate method is used to widen the window or to allow it to shift to a higher or lower location. Each time an acceptable coin happens to coincide with an edge-value, that edge is pushed back by one step. Taking the example of C=4 to 10, if an acceptable coin has an actual value of C=4, the range of C would immediately be increased by one to C=3 to 10. If, on the other hand, an actual C=10 occurs, the range would be changed to C=4 to 11.

The combination of these two techniques gives the ability to shift the location and width of the accept-window. The edge of the window can be shifted very rapidly by this means, enabling the coin inspecting circuit to compensate for a relatively fast drift in circuitry components. The rate of improving selectively, or coin discriminating power, (which stems from narrow window width) can be independently controlled. The speed with which the width of the window is reduced may be controlled by varying the number of coins that must be counted without any coin hitting the C-limits.

The tracking scheme according to the present invention preferably uses two different rates of window narrowing. The faster rate is used after a change in N or after initial programming. At these times, a wider-than-necessary window must be narrowed as rapidly as possible to give good coin-discriminating power. When the coin inspecting circuit senses that its window is adequately narrow, it shifts to a less frequent narrowing mode.

With reference to the flow chart of FIG. 13, it should first be noted that following the acceptance of a coin, the coin inspecting circuit 10 makes two passes through this flow chart, namely, once for the left test and once for the right test. At block 180, the circuit 10 takes either the "yes" branch, proceeding through steps that push back one or the other edge of the window, or the "no" branch. If the "no" branch is taken, the circuit 10 checks to see if it should narrow the window and narrows it if necessary.

Assuming the "yes" branch was taken from block 18, the circuit 10 checks a tracking-mode bit in block 182 to see if it is slow-tracking or fast-tracking. If the circuit 10 has recently been programmed or has recently had to change the value of N for the coin test currently under consideration, the circuit will be fast-tracking. If the circuit 10 finds that it is not fast tracking, it takes the "no" branch to block 184. If it finds it is fast tracking, the circuit 10 proceeds to block 186.

At block 186, the circuit 10 checks the number of this kind of coin that have been accepted since this internal microcomputer counter was reset to zero. This counter is reset to zero at several points on this flow chart and starts out at zero when the unit is initially programmed. This counter, generally speaking, holds the number of coins that have been accepted since an accepted coin hit an edge of the window for the specific test under consideration. There is a separate counter for the right and for the left-test for each kind of coin the circuit 10 accepts.

If this counter contains fewer than eight coins, the "no" branch is taken to block 184. If it contains eight or more, the circuit 10 takes the "yes" branch to block 188. In the former case, the circuit 10 continues fast tracking, and in the latter case it stops fast tracking. In this event it is desired to stop fast tracking because it took eight or more coins to hit an edge-value of the window, and it is therefore not likely that the window's position is very far off where it should be, and slow tracking should now suffice. On the other hand, if an edge was encountered in fewer than eight coins, it is assumed that the window is not positioned very well as yet. Since this window may continue shifting to one side as the next several coins are accepted, it is desirable to continue to allow the window to narrow rather rapidly to drag the trailing edge of the window along in the direction of shift.

After block 188, the different branches rejoin, and the counter is reset to zero in block 184. At block 190, the circuit 10 determines which edge of the window was encountered. If it was the lower edge, the circuit 10 proceeds to block 192 where the lower edge of the window is shifted down one step. Since an acceptable coin has happened to hit the former edge of the window, the edge is pushed back one step to give a margin of safety . This, of course, increases the over-all width of the window. If the window has been made wider than necessary by this change, it will later be narrowed again.

If it were an upper edge of the window that had been contacted, the circuit 10 would have passed to block 194 where it would have shifted the upper edge up one step. However, if it was the lower edge that was hit, the circuit 10 would proceed to block 196. Here the value of the lower edge (which will now be one step lower than it previously was) is examined to see if it is too close to C=0. If it were, N would be changed in the direction that would move the window up. As previously discussed, an approximate window would be selected, and the circuit 10 would go to block 198 setting itself back into the fast tracking mode.

It should also be noted that, if the upper edge of the window had been hit, and, in block 194 that edge was incremented, the circuit would then bypass block 196. This is because the decision to change N is preferably always based upon the lower edge of the window and never on the upper.

At this point, all paths would rejoin at block 200 where the decision whether or not to rewrite the window-edge locations (upper and lower values of C) and the N. Only if the new values are substantially different from those currently stored will this be done.

Starting again at block 180 and taking the "no" branch, which is the most frequent route, the circuit 10 proceeds to block 202 and checks the number of coins since an edge was contacted last. If fewer than eight were contacted, the circuit 10 returns to the main body of the program, making no alterations to it programming for the test under consideration.

If the count is eight or greater, but less than sixteen, the circuit 10 proceeds to block 204 and checks to see if it is fast tracking. If it is not, it returns to the main body of the program. If it is, the circuit 10 proceeds to block 206 and turns off the fast tracking feature. Fast-tracking preferably should not be allowed to continue through more than two consecutive narrowings of the window, as the window is never so wide that more than two narrowings should be required in a short period.

Returning to block 202, if a count of sixteen is reached, the circuit 10 will proceed to block 208, and will reset the counter to zero. From here the circuit 10 rejoins with the fast tracking route, arriving at block 210. The window is narrowed by both decrementing the upper edge of the window and incrementing the lower edge of the window.

The circuit 10 then proceeds to block 196. Since the lower edge of the window will just have been moved up one step, it is possible that it will have become too far away from C=0, and a change in N may be required. From this point on, the circuit follows the same course as discussed previously.

Figure 14:
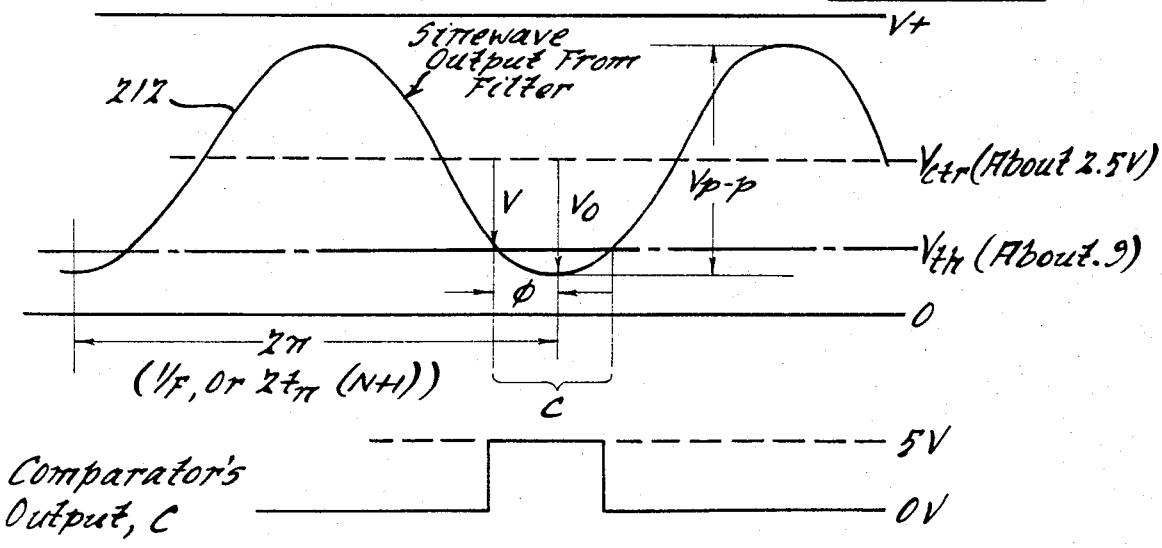
FIG. 14 is a diagram useful in illustrating the calculations required in the coin acceptor circuit shown in FIG. 7.

Referring to FIG. 14, a diagram is shown which is useful in illustrating the deriation for the equation used to calculate the value C. The curve 212 represents the sinusoidal output of the LC filter, such as the filter 14. The frequency of this sine wave will be equal to the frequency of the square wave driving signal that is applied to the filter, as long as the square wave frequency remains constant for a long enough time that the sine wave becomes stable. Therefore, the period of the sine wave is shown as 1/F, where F is the frequency (proportional to N) of the driving square wave.

The lower-case c in the diagram refers to the length of a pulse issued by the comparator, having a continuously variable length. Upper-case C is an integer measure of the length of c, composed of a count of externally generated pulses. The length of one of these externally generated pulses is $t_C$.

The length of one sine wave cycle (or of one square wave cycle driving the filter) is 1/F. The period 1/F is equal to $2t_N(N+1)$, where $t_N$ is another externally generated pulse.

The angle $\phi$, introduced merely as a tool in this derivation, is a measure in radians of one-half c. $V_o$ is the amplitude of the sine wave ($V_o=\frac{1}{2}V_{p-p}$).

What is desired is an expression relating C to the amplitude of the sine wave, given certain values of constants. To find this, $\phi$ must first be found. Assuming one sine wave cycle to be two pi radians, trigonometry provides:

$$V_o \cos \phi = V = V_{ctr} - V_{th}$$

$$\cos \phi = (V_{ctr} - V_{th})/V_o$$

$$\phi = \cos^{-1} (V_{ctr} - V_{th})/V_o) \qquad \text{Eqn. 1}$$

Putting $\phi$ into more pertinent terms:

$$\phi/2 = \tfrac{1}{2}c/2t_N(N+1)$$

$$\phi = c/2t_N(N+1) \qquad \text{Eqn. 2}$$

Substituting Eqn. 2 into Eqn. 1, and solving for c:

$$c = \frac{(2t_N(N + 1(\cos - 1((V_{ctr} - V_{th})/V_o)}{\pi}$$

And, finally, to put this into terms of C, C is divided by $T_C$ which results in:

$$C = \frac{(2t_N(N + 1)\cos - 1((V_{ctr} - V_{th})/V_o)}{\pi\, t_c} \quad \text{Eqn. 3}$$

While other coin acceptors are generally quite sensitive to supply voltage variation, the above expression shows that a coin inspecting circuit in accordance with the present invention is still reliable when operated from only loosely regulated supplies. From Equation 3 it can be seen that C is proportional to the ratio of (Vctr−Vth)/Vo. Additionally it should be noted that all three of these voltages are directly proportional to V+; as V+ varies, this ratio remains constant. Measurement of C is thus independent of supply voltage, as is the balance of the coin discriminating circuitry since it is digital.

The externally generated pulses, $t_N$ and $t_C$, in the preferred embodiment, are taken from a 4 MHz crystal oscillator ($t_N = \frac{1}{4}$MHz = 0.25 μsec) and from this oscillator divided by four ($t_C = 1$ μsec), respectively. The microcomputer unit used in the preferred embodiment operates on this 4 MHz oscillator, and internally generates the divided-by-four time base, $t_C$.

Referring now to FIGS. 15–18, the mechanical aspects of an electronic coin acceptor in accordance with the present invention will now be described. Elimination of moving parts and mechanisms is a key factor in attaining high reliability in a coin acceptor. An acceptor with no moving parts is far less prone to malfunction caused by dirt, wear, jamming, or contamination by sticky liquids. Yet some prior electronic acceptors still use moving parts for purposes such as regulating the speed of coins as they pass through the unit or for gauging the size of coins. Moreover, some electronic units still rely on a mechanical micro-switch, tripped by the coin. However, the electronic coin acceptor described herein contains no moving parts, with the exception of an electro-mechanical solenoid, such as solenoid 136. This solenoid is required for coins to be physically gated either to the coin return or into the machine's coin vault.

The speed of the coin and position of the coin should be consistent at the point where testing of the coin occurs, if consistent testing results are desired. A coin may be put into the entry many ways—ranging from being delicately released to being propelled into the slot and may have either no spin or a good deal of spin. It is, therefore, desirable to remove all entry effects from a coin and impart a uniform motion to the coin at some point prior to testing.

Figure 15:
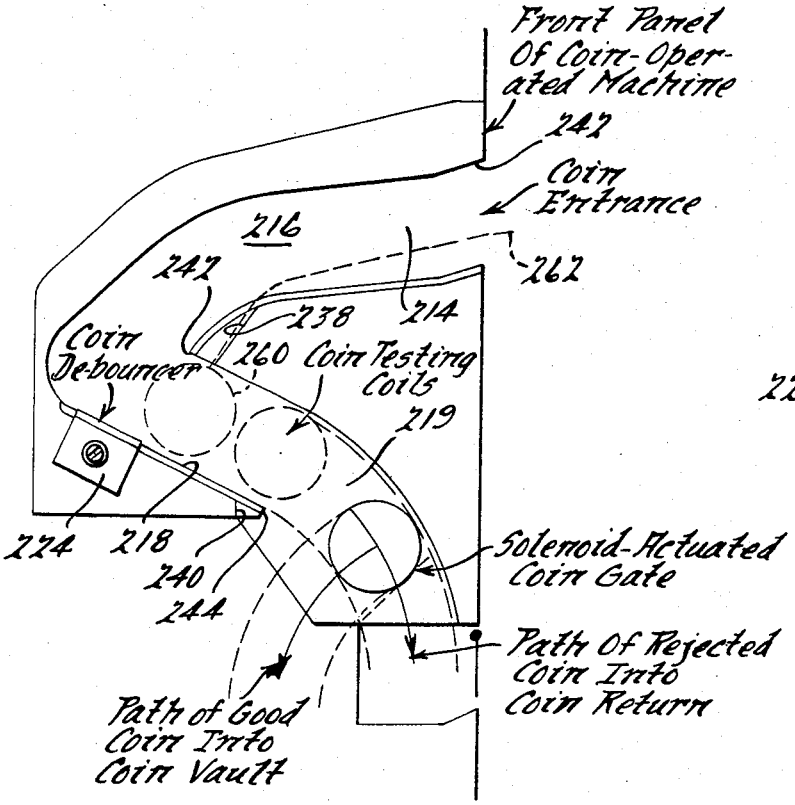
FIG. 15 is a side elevation view of the coin slot for an electronic coin acceptor in accordance with the present invention.
Figure 16:
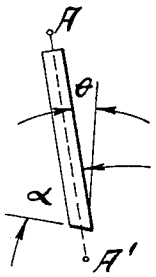
FIG. 16 is a diagram of the angles used in designing the coin slot shown in FIG. 15.

This is accomplished in the present electronic coin acceptor by first having the coin roll along a gradual and long enough inclined channel 214 that even a coil rapidly propelled into the entry is likely to have contacted the bottom of the channel prior to the end of the incline. This channel is shown in FIG. 15, which illustrates a side elevation view of coin chute 216. The channel 214 is tilted from vertical by an angle, $\theta$, sufficient to ensure that the coil tends to contact one wall of the channel by force of gravity acting on the center of gravity of the coin. This angle is illustrated in FIG. 16. The floor or bottom of the channel 214 is not perpendicular with the walls of the channel, but is sloped at an angle of, $\alpha$, sufficient that the bottom edge of the coin will tend to contact the opposite wall from the wall contacted by the top edge of the coin contacts. The passage of a coin through the channel 214 is thus made predictable. The coin is neither prone to clatter from side to side, nor to bounce on the floor of the channel. Kinetic energy in the coin that might cause bouncing is dissipated instead by friction of the wedging action of the coin against the channel floor. If the face of a coin comes into full contact with a channel wall, it tends to stick or roll too slowly due to vacuum developed between it and the channel wall or due to possible accumulation of sticky substances on channel walls. A further advantage of this design is that the coin is constrained to contact the walls of the channel 214 only at the circumference (i.e., edges) of the coin. This reduces a tendency for excessive friction with channel walls.

After having passed through the channel 214, the path of the coin will have been normalized, to a degree, even though the speed and/or spin of the coin still may variy. Therefore, the coin is caused to fall, by virtue of its momentum and gravity, onto a channel floor 218 similar to its tilted and angled orientation to the previous channel 214, but more steeply inclined, in the preferred embodiment.

Figure 17A:
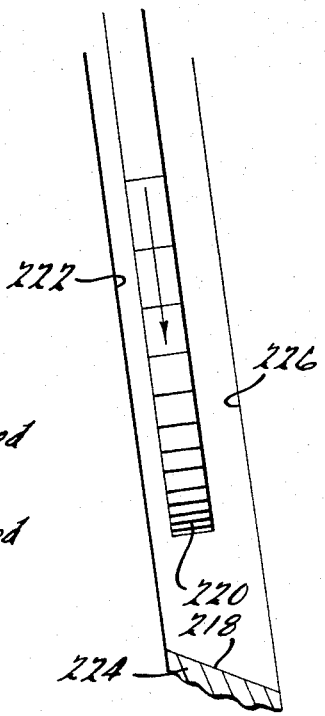
FIGS. 17*a*–17*c* are cross-sectional views of the coin slot shown in FIG. 15.
Figure 17B:
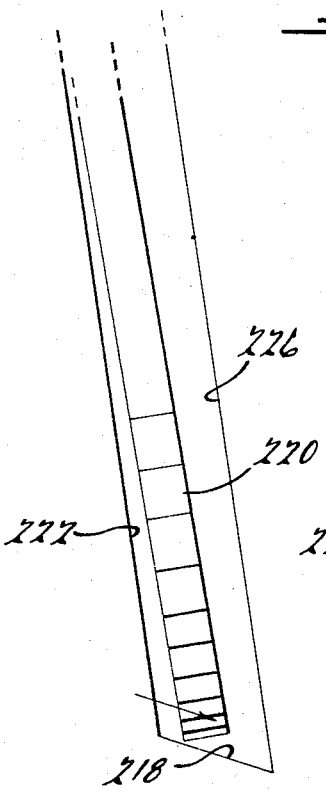
Figure 17C:
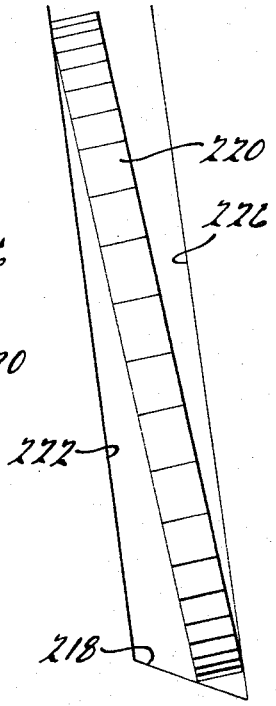

Referring to FIG. 17*a*, a coin 220 will fall into channel 219 generally, but not necessarily along the left wall 222 (as drawn, but along the right wall for a channel tilting the opposite way). It may have variable speed and/or spin. In FIG. 17*b*, the coin 220 has contacted the floor 218 of channel 219, and its downward momentum has been redirected toward the lowest point of the channel floor. The coin 220 tends to rotate about its center of gravity at this point, bringing the coin's upper edge toward the left channel wall 222. In FIG. 17*c*, the coin 220 has impacted into the wedge formed between the floor 218 and the right wall 226. The pinching effect of this wedge very shortly absorbs all downward or sideways momentum of the coin, while the tilt of the channel 219 causes the coin's top edge to come to rest against the left channel wall 222. Any coin, regardless of how it was inserted into the entry of the coin acceptor, comes momentarily to rest in this location, divested of all entry effects. At this point, the incline of the channel 219 causes the coin to begin rolling down the channel 219. The channel 219 maintains the same cross-section from this point to the point where coin testing coils 228 are located. Therefore, as the coin 220 passes between the testing coils 228, its speed and orientation are consistent.

Figure 18:
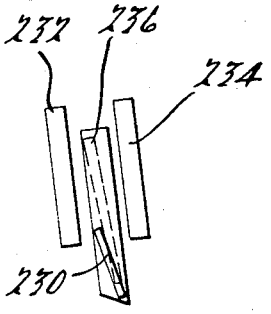
FIG. 18 is a cross-sectional view of the coin slot shown in FIG. 15, particularly illustrating the position of the sensing coils.

The sensing coils 228 are two identical coils, in the preferred embodiment, connected serially so that their fields' reinforce one another. A coin passing between them strongly affects the value of the inductance and the loss characteristic of the coils. In one embodiment, the axis of the coils is offset upwards from the floor of the channel down which the coin rolls. Thus, the axis of the coils will be eccentrically located with respect to even the largest coin that may pass through the channel. The effect of this offset is to increase discrimination among coins on the basis of diameter. Thus, as illustrated in FIG. 18, a coin 230 of small diameter, extends only a small distance into the sensing field of the coils 232–234. Whereas, a coin 236 of larger diameter extends more deeply into the sensing field of the coils 232–234.

While two coils connected serially comprise the sensing element in the preferred embodiment, it should be understood that many forms of sensing coils may be employed.

It should also be noted that the coin chute 216 of FIG. 15 is also designed to prevent "string-fraud" on the coin acceptor. A common method of defrauding a coin acceptor is to tie a string to a coin, insert it into the slot, receive credit or dispense items from the machine, then extract the coin by means of the string. A standard means of preventing string-frauds is to put a mechanism in the channel the coin must follow that will toggle to allow coin entry, but will not toggle in the reverse direction to permit extraction of the coin. Such devices are effective, but, as moving parts, bear a certain probability of mechanical malfunction.

As the coin passes through the coin acceptor prior to or after the point at which testing occurs, it is caused to make a change of direction. This change of direction, if equipped with appropriate means of string entrapment, may be navigated by a coin flowing into the acceptor under the effects of gravity—but may not be counter-navigated by a coin, under the influence of a string. The string 262, by means of the entrapment, is caused to pull on the coin 260 in a direction that is blocked to the passage of the coin, but that is open to the string, by virtue of the string's smaller thickness, with respect to the thickness of a coin. The string must then either be broken or released by the person attempting the fraud. This means of entrapment is provided in the coin chute 216 by the change in directions between channels 214 and 219, and the string catching slots 238 and 240. Once a coin passes by either of edges 242 or 244, the coin will not be able to navigate its way backward due to the change in the angle of the narrow coin channels and the string catching slots 238 and 240. The slots 238 and 240 are preferably formed along the lowest edge of the channel floors so that the string 262 will gravitate and fall into these slots when the coin 260 passes the respective edges 242 and 244. It should also be appreciated that the width of the slots 238 and 240 should be large enough for the string 262 to pass therethrough, but narrow enough to prevent the coin 262 from entering the slots.

A second form of string-fraud consists of obtaining multiple credits using a single coin on a string by passing the coin on the string repeatedly through the portion of the acceptor that issues credits to the coin operated machine. In the case of an electronic coin acceptor that does not use a microswitch, such as the present acceptor, this might be accomplished by repeatedly letting the coin pass through the sensing coils. In order to prevent this fraud, the testing method is intentionally made to be sensitive to the speed of the coin by application of suitable timing constraints. The coin test is configured in such a way that a coin must pass from the point at which its approach is first sensed, to the point at which it is sensed that the coin is centered and is of the acceptable type, and thence must pass from this point to the point where it is sensed that the coin has exited from the coils 228, in order for the coin to be accepted. If the time from the sensing of approach to the time when centered, or the time from centered to exit is incorrect, a coin will not be accepted, even if it is known to be of the acceptable type.

Another advantage of the coin chute 216 is derived from the material used for its construction. Blockage of coin channels represents the most common cause of failure of coin acceptors, and is potentially a cause of failure with any acceptor, even if precautions are taken to minimize probability of such eventuality. To minimize this problem, at least one of the acceptor side-plates for the coin chute 216 is made of clear, rugged plastic (i.e., Lexan), along one entire side of the coin channel. Any blockage may immediately be spotted by an operator upon unlocking the machine and glancing at the acceptor. The blockage may then be quickly removed by removing this clear side plate. With the coin chute constructed from plastic, it should be noted that it may be advisable to provide a metal debouncer strip 224 along the floor 218 at the beginning of the channel 219 to minimize the possibility of wear at the point where the coin will drop onto the floor of this channel.

It is also preferable that any object that is too thick, too bent, or too large in diameter to pass through the coin acceptor, be prevented from entering the acceptor. Accordingly, it should be noted that the coin chute 216 is also designed to have a constricted entry 242 for this purpose. The remaining length of the coin channel has a greater width and height than this constricted portion ensuring that an object too large to pass smoothly through the entire channel may not enter the channel.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

We claim:

1. A coin inspecting circuit, comprising:

means for generating an input driving signal which is selectively varied between at least two predetermined characteristics;

means for creating an electromagnetic field which is varied in response to said driving signal and for producing alternating signals which are responsive to a conductive object in the presence of said electromagnetic field;

means for measuring said alternating signals and determining whether a conductive object in the presence of said electromagnetic field is an acceptable coin from said alternating signals.

2. The coin inspecting circuit according to claim 1, wherein said electromagnetic field creating means comprises an inductive filter, and said two selectively varied characteristics of said driving signal comprise two distinct frequencies.

3. The coin inspecting circuit according to claim 2, wherein said generating means is capable of selectively generating an input driving signal having at least a first frequency below the resonant frequency of said inductive filter and an input driving signal having at least a second frequency above the resonant frequency of said inductive filter.

4. The coin inspecting circuit according to claim 3, wherein said first frequency is substantially below and said second frequency is substantially above the resonant frequency of said inductive filter.

5. The coin inspecting circuit according to claim 4, wherein said first and second frequencies cause said inductive filter to produce alternating signals having substantially the same amplitude.

6. The coin inspecting circuit accordding to claim 5, wherein said driving signal has a generally square waveform, and said alternating signals have a generally sinusoidal waveform.

7. The coin inspecting circuit according to claim 2, wherein said inductive filter comprises a pair of series connected sensing coils, and a pair of capacitors, one of said capacitors being connected at one end of said pair of sensing coils and the other of said capacitors being connected at the other end of said pair of sensing coils.

8. A coin inspecting circuit for testing the acceptability of coins of at least two different denominations, comprising:

means for generating an input driving signal having a selectively variable characteristic;

means for controlling said selectively variable characteristic of said driving signal such that at least one predetermined testing characteristic for each coin denomination to be tested for acceptability is selected for said driving signal in a predetermined sequence;

means for creating an electromagnetic field which is varied in response to said driving signal and for producing a sequence of alternating signals which are responsive to a conductive object in the presence of said electromagnetic field;

means for detecting when each said alternating signal crosses a predetermined threshold level and for producing a level detect signal indicative of each said threshold crossing; and means for determining whether a conductive object in the presence of said magnetic field is an acceptable coin from said level detect signal.

9. The coin inspecting circuit according to claim 8, wherein said controlling means causes said driving signal to be generated at an idling characteristic when no conductive object is in the presence of said electromagnetic field, and said controlling means causes said driving signal to be generated with said predetermined sequence of said testing characteristics when a conductive object is in the presence of said electromagnetic field.

10. The coin inspecting circuit according to claim 9, wherein said determining means includes means for sensing the entrance of a conductive object into said electromagnetic field from said level detect signal.

11. The coin inspecting circuit according to claim 10, wherein said electromagnetic field creating means comprises an inductive filter.

12. The coin inspecting circuit according to claim 11, wherein said idling characteristic and each of said testing characteristics is an off-resonant frequency with respect to said inductive filter.

13. The coin inspecting circuit according to claim 12, wherein said controlling means causes said generating means to generate a pair of predetermined off-resonant testing frequencies to be generated for each of said coin denominations to be tested for acceptability in said predetermined sequence when said sensing means senses the entrance of a conductive object into said electromagnetic field.

14. The coin inspecting circuit according to claim 13, wherein each of said pairs of predetermined off-resonant testing frequencies includes a first frequency below the resonant frequency of said inductive filter and a second frequency above the resonant frequency of said inductive filter.

15. The coin inspecting circuit according to claim 14, wherein said determining means includes means for counting the period between said threshold crossings, and means for examining whether the count value produced by said counting means is within a predetermined boundary for each of said coin denominations to be tested.

16. The coin inspecting circuit according to claim 15, wherein said controlling means and said determining means comprise a microcomputer having electronically erasable-programmable means for storing said idling and testing frequencies and said predetermined boundaries, and means for altering said idling and testing frequencies and said predetermined boundaries stored in said storing means to compensate the coin acceptability criteria for coin variations and circuit instability.

17. A coin inspecting circuit, comprising:

means for storing at least one predetermined input testing characteristic for each coin denomination to be tested for acceptability; and means for determining whether a conductive object is an acceptable coin by creating an electromagnetic field utilizing said input testing characteristics in a predetermined sequence, such that said electromagnetic field is varied in response to said input testing characteristics, and measuring the affect upon said electromagnetic field when a conductive object is in the presence of said electromagnetic field.

18. The coin inspecting circuit according to claim 17, wherein said storing means comprises an electronically erasable-programmable memory.

19. The coin inspecting circuit according to claim 18, including means for altering said input testing characteristics stored in said electronically erasable-programmable memory to compensate for degree of variability in each acceptable coin denomination.

20. The coin inspecting circuit according to claim 19, wherein said altering means also alters said input testing characteristics stored in said electronically erasable-programmable memory to compensate for circuit instability.

21. The coin inspecting circuit according to claim 20, wherein said electronically erasable-programmable memory also stores at least one predetermined idling characteristic in addition to said input testing characteristics, and said determining means includes means for sensing the entrance of a conductive object into said electromagnetic field when said idling characteristic is used to create said electromagnetic field.

22. In an apparatus which is operable in response to the receipt of at least one acceptable coin, an electronic coin acceptor for testing the acceptability of received coins comprising:

frequency synthesizer means for generating a driving signal having a selectively variable frequency;

inductive filter means for creating an electromagnetic field and for producing an alternating signal which is responsive to a conductive object in the presence of said electromagnetic field;

comparator means for detecting when said alternating signal crosses a predetermined threshold level and for producing a level detect signal indicative of said threshold crossing; and microcomputer means for controlling said frequency synthesizer means by selecting predetermined frequencies for said driving signal, for sensing the entrance of a conductive object into said electromagnetic field, and for determining whether a conductive object in the presence of said electromagnetic field is an acceptable coin.

23. A method of testing the acceptability of a coin, comprising the steps of:

providing at least one input setting characteristic for each coin denomination to be tested for acceptability;

creating an electromagnetic field which is varied in response to said testing characteristics in a predetermined sequence; and measuring the effect upon said electromagnetic field when a conductive object is in the presence of said electromagnetic field; and determining whether a conductive object in the presence of said electromagnetic field is an acceptable coin from the changes in said electromagnetic field.

24. The method according to claim 23, including the step of storing said testing characteristics in a non-volatile memory.

25. The method according to claim 24, including the step of altering said testing characteristics to compensate for the degree of variability in each acceptable coin denomination.

26. The method according to claim 24, further including the step of altering said testing characteristics to compensate for circuit instability.

27. The method according to claim 23, including the steps of providing at least one idling characteristic, creating an electromagnetic field utilizing said idling characteristic when no conductive object is in the presence of said electromagnetic field, detecting a change in said electromagnetic field, and sensing the entrance of a conductive object into said electromagnetic field from the change in said electromagnetic field.

28. A method of testing the acceptability of a coin in a coin operated apparatus, comprising the steps of:

generating an input driving signal with a predetermined sequence of testing frequencies, at least one testing frequency being provided for each coin denomination to be tested for acceptability;

creating an electromagnetic field in response to said driving signal and producing a sequence of alternating signals which are responsive to a conductive object in the presence of said electromagnetic field;

detecting when each said alternating signal crosses a predetermined threshold level and producing a level detect signal indicative of each said threshold crossing; and determining whether a conductive object in the presence of said magnetic field is an acceptable coin from said level detect signal.

29. The method according to claim 28, wherein said electromagnetic field is created by an inductive filter, and each of said testing frequencies is an off-resonant frequency with respect to said inductive filter.

30. The method according to claim 29, wherein a pair of off-resonant testing frequencies is provided for each of said coin denominations to be tested, one of said testing frequencies in each of said pairs being below the resonant frequency of said inductive filter and the other of said testing frequencies in each of said pairs being above the resonant frequency of said inductive filter.

31. A method of dynamically testing the acceptability of coins in a coin operated apparatus, comprising the steps of:

establishing a criteria for determining the acceptability of at least one coin denomination;

testing a conductive object to determine whether said conductive object is an acceptable coin;

producing at least one resulting signal from said test;

determining whether said conductive object is an acceptable coin from said resulting signal;

establishing a criteria for automatically determining when said coil acceptability criteria should be altered from the value of said resulting signal; and selectively altering said coin acceptability criteria for subsequent determinations of coin acceptability in response to the value of said resulting signal.

32. The method according to claim 31, wherein said altering of said coin acceptability criteria compensates for the degree of variability in said acceptable coin denomination.

33. The method according to claim 32, wherein said altering of said coin acceptability criteria compensates for mechanical and electrical changes in said coin operated apparatus, including changes in ambient conditions.

34. The method according to claim 31, wherein said coin acceptability criteria comprises a range of values within which a coin will be determined to be acceptable.

35. The method according to claim 34, wherein said range is narrowed when the values for a predetermined number of said resulting signals for acceptable coins do not reach either boundary of said range.

36. The method according to claim 34, wherein said range is widened when the value for a resulting signal of an acceptable coin reaches one of the boundaries of said range.

37. The method according to claim 34, wherein the frequency at which said range is altered varies in response to predetermined conditions.

38. The method according to claim 37, wherein said range is altered at a first frequency to compensate for slowly changing conditions, and said range is altered at a second frequency to compensate for rapidly changing conditions.

39. The method according to claim 35, wherein said range is shifted when the value for a resulting signal of an acceptable coin reaches one of the boundaries of said range.

40. In a coin operated apparatus a coin inspecting circuit for dynamically testing the acceptability of coins, comprising:

means for testing a conductive object to determine whether said conductive object is an acceptable coin in accordance with a predetermined coin acceptability criteria;

means for determining whether said conductive object is an acceptable coin from the result of said test; and means for selectively and automatically altering said coin acceptability criteria for a subsequent determination of coin acceptability in response to the result of said test and in accordance with a predetermined criteria for determining when said coin acceptability criteria should be altered.

41. The coin inspecting circuit according to claim 40, including means for storing said coin acceptability criteria.

42. The coin inspecting circuit according to claim 40, including means for establishing said initial coin acceptability criteria by testing at least one known acceptable coin.

* * * * *

UNITED STATES PATENT AND TRADEMARK OFFICE

CERTIFICATE OF CORRECTION

PATENT NO. : 4,538,719

DATED : September 3, 1985

INVENTOR(S) : MATTHEW H. GRAY and ROBERT D. EVERETT

It is certified that error appears in the above-identified patent and that said Letters Patent is hereby corrected as shown below:

| | | |
|---|---|---|
| Column 1, | line 44 | delete "the these" and insert therefor --these-- |
| Column 3, | line 26 | delete "through" and insert therefor --though-- |
| Column 3, | line 44 | delete "tendancy" and insert therefor --tendency-- |
| Column 3, | line 61 | delete "coil" and insert therefor --coin-- |
| Column 9, | line 28 | insert --logic state-- after "LO" |
| Column 11, | line 32 | delete "microprocomputer" and insert therefor --microcomputer-- |
| Column 11, | line 36 | delete "microprocomputer" and insert therefor --microcomputer-- |

UNITED STATES PATENT AND TRADEMARK OFFICE

CERTIFICATE OF CORRECTION

PATENT NO. : 4,538,719

DATED : September 3, 1985

INVENTOR(S) : MATTHEW H. GRAY and ROBERT D. EVERETT

It is certified that error appears in the above-identified patent and that said Letters Patent is hereby corrected as shown below:

| | | |
|---|---|---|
| Column 11, | line 39 | delete "microprocomputer" and insert therefor --microcomputer-- |
| Column 11, | line 55 | delete "and" and insert therefor --are-- |
| Column 15, | line 3 | delete "microprocomputer" and insert therefor --microcomputer-- |
| Column 15, | line 23 | delete "42" and insert therefor --142-- |
| Column 18, | line 8 | delete "beomes" and insert therefor --becomes-- |
| Column 18, | line 51 | delete "thay" and insert therefor --that-- |

UNITED STATES PATENT AND TRADEMARK OFFICE

CERTIFICATE OF CORRECTION

PATENT NO. : 4,538,719

DATED : September 3, 1985

INVENTOR(S) : MATTHEW H. GRAY and ROBERT D. EVERETT

It is certified that error appears in the above-identified patent and that said Letters Patent is hereby corrected as shown below:

| | |
|---|---|
| Column 18, line 57 | delete "onto" and insert therefor --into-- |
| Column 19, line 25 | delete "then" and insert therefor --than-- |
| Column 19, line 63 | delete "braching" and insert therefor --branching-- |
| Column 20, line 3 | delete "falls" and insert therefor --fails-- |
| Column 22, line 3 (Page 38, line 23) | delete "charge" and insert therefor --change-- |
| Column 22, line 40 | delete "coint" and insert therefor --coin-- |

UNITED STATES PATENT AND TRADEMARK OFFICE

CERTIFICATE OF CORRECTION

PATENT NO. : 4,538,719

DATED : September 3, 1985

INVENTOR(S) : MATTHEW H. GRAY and ROBERT D. EVERETT

It is certified that error appears in the above-identified patent and that said Letters Patent is hereby corrected as shown below:

| | | |
|---|---|---|
| Column 24, | line 32 | delete "selectively" and insert therefor --selectivity-- |
| Column 24, | line 57 | delete "18" and insert therefor --180-- |
| Column 26, | line 25 | delete "deriation" and insert --derivation--therefor |
| Column 27, | line 65 | delete "coil" and insert therefor --coin-- |
| Column 28, | line 22 | delete "variy" and insert therefor --vary-- |
| Column 28, | line 24 | delete the first "to" and insert --in--therefor |

UNITED STATES PATENT AND TRADEMARK OFFICE

CERTIFICATE OF CORRECTION

PATENT NO. : 4,538,719

DATED : September 3, 1985

INVENTOR(S) : MATTHEW H. GRAY and ROBERT D. EVERETT

It is certified that error appears in the above-identified patent and that said Letters Patent is hereby corrected as shown below:

| | | |
|---|---|---|
| Column 31, | line 1 | delete "accordding" and insert --according--therefor |
| Column 33, | line 5 | delete "setting" and insert therefor --testing-- |
| Column 34, | line 7 | delete "coil" and insert therefor --coin-- |

Signed and Sealed this

*Twenty-second* Day of *April 1986*

[SEAL]

*Attest:*

DONALD J. QUIGG

*Attesting Officer* *Commissioner of Patents and Trademarks*